US012612760B2

(12) United States Patent
Sano

(10) Patent No.: US 12,612,760 B2
(45) Date of Patent: Apr. 28, 2026

(54) SHOVEL, SHOVEL CONTROL DEVICE, AND MACHINE LEARNING DEVICE

(71) Applicant: SUMITOMO HEAVY INDUSTRIES, LTD., Tokyo (JP)

(72) Inventor: Yusuke Sano, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 195 days.

(21) Appl. No.: 18/509,816

(22) Filed: Nov. 15, 2023

(65) Prior Publication Data

US 2024/0167245 A1 May 23, 2024

(30) Foreign Application Priority Data

Nov. 17, 2022 (JP) ..... 2022-184301

(51) Int. Cl.
*E02F 3/43* (2006.01)
*E02F 9/26* (2006.01)

(52) U.S. Cl.
CPC ..... *E02F 3/439* (2013.01); *E02F 3/437* (2013.01); *E02F 9/262* (2013.01)

(58) Field of Classification Search
CPC ... E02F 3/28; E02F 3/345; E02F 3/347; E02F 3/36; E02F 3/439; E02F 3/965; E02F 9/00; E02F 9/08; E02F 9/0858; E02F 9/16; E02F 9/20; E02F 9/2025; E02F 9/2058; E02F 9/207; E02F 9/22; E02F 9/2203; E02F 9/2267; E02F 9/2285; E02F 9/2292; E02F 9/2296; E02F 9/26; E02F 9/262; E02F 9/264; E02F 9/265; E02F 3/43; B60Y 2200/412
USPC ..... 701/50
See application file for complete search history.

(56) References Cited

U.S. PATENT DOCUMENTS

| | | | | |
|---|---|---|---|---|
| 11,066,808 | B2 * | 7/2021 | Takeuchi | E02F 3/435 |
| 2014/0110168 | A1 * | 4/2014 | Pursimo | E21B 7/025 701/50 |
| 2021/0355651 | A1 | 11/2021 | Itoh et al. | |
| 2023/0417024 | A1 * | 12/2023 | Wu | E02F 9/2025 |
| 2025/0034839 | A1 * | 1/2025 | Yamamoto | E02F 3/964 |

FOREIGN PATENT DOCUMENTS

| | | |
|---|---|---|
| JP | 2019-044582 | 3/2019 |
| WO | 2020/162428 | 8/2020 |
| WO | 2022/196776 | 9/2022 |

* cited by examiner

*Primary Examiner* — Andrew Joseph Rudy
(74) *Attorney, Agent, or Firm* — IPUSA, PLLC

(57) ABSTRACT

A shovel control device includes a processor and a memory storing one or more programs, which when executed, cause the processor to execute: determining a target releasing position based on a feature of a ground recognized by a space recognition device; and controlling a swiveling movement of an upper swiveling body of a shovel so that the upper swiveling body is oriented toward the target releasing position. The shovel includes a lower traveling body, the upper swiveling body swivelably mounted on the lower traveling body, attachments attached to the upper swiveling body and including a boom, an arm, and an end attachment, and the space recognition device configured to recognize the feature of the ground.

11 Claims, 12 Drawing Sheets

SHOVEL, SHOVEL CONTROL DEVICE, AND MACHINE LEARNING DEVICE

CROSS-REFERENCE TO RELATED APPLICATIONS

This application is based upon and claims priority to Japanese Patent Application No. 2022-184301, filed on Nov. 17, 2022, the entire contents of which are incorporated herein by reference.

BACKGROUND

1. Technical Field

The present disclosure relates to shovels, shovel control devices, and machine learning devices.

2. Description of Related Art

Shovels having functions in relation to movements of releasing objects in buckets toward the ground have been known.

In the above-described shovel, an operator, who performs excavation, performs an excavating operation including an arm closing operation or the like, and then performs a releasing operation for releasing earth and sand in a bucket toward a position on the ground that is away from an excavating position. Specifically, the operator performs a boom raising operation and a swiveling operation, thereby moving the bucket filled with the earth and sand to a position directly above a desired releasing position, and then performs a bucket opening operation, thereby releasing the earth and sand in the bucket toward the ground. This is for making it possible to perform the next excavating operation. In this way, the above-described shovel requires the operator to perform the releasing operation, including the swiveling operation and the bucket opening operation, every time an excavating movement is performed in accordance with the excavating operation. Therefore, this may impose a heavy burden to the operator.

SUMMARY

A shovel control device according to an embodiment of the present disclosure includes a processor, and a memory storing one or more programs, which when executed, cause the processor to execute determining a target releasing position based on a feature of a ground recognized by a space recognition device, and controlling a swiveling movement of an upper swiveling body of a shovel so that the upper swiveling body is oriented toward the target releasing position. The shovel includes a lower traveling body, the upper swiveling body swivelably mounted on the lower traveling body, attachments attached to the upper swiveling body and including a boom, an arm, and an end attachment, and the space recognition device configured to recognize the feature of the ground.

DETAILED DESCRIPTION

In view of the above, it is desired to reduce the burden on the operator in relation to the releasing movement.

Figure 1:
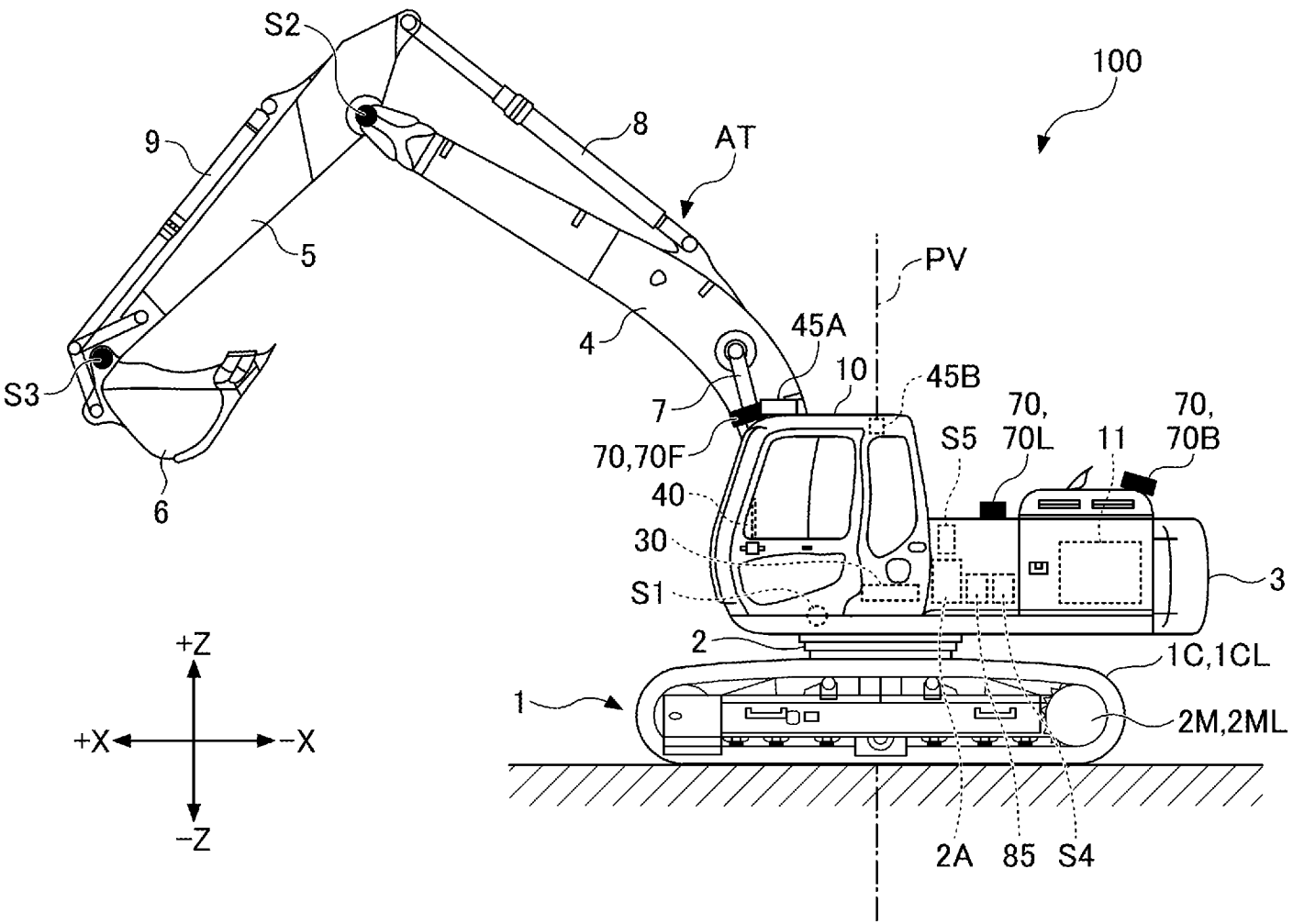
FIG. 1 is a lateral view of a shovel according to an embodiment of the present disclosure.
Figure 2:
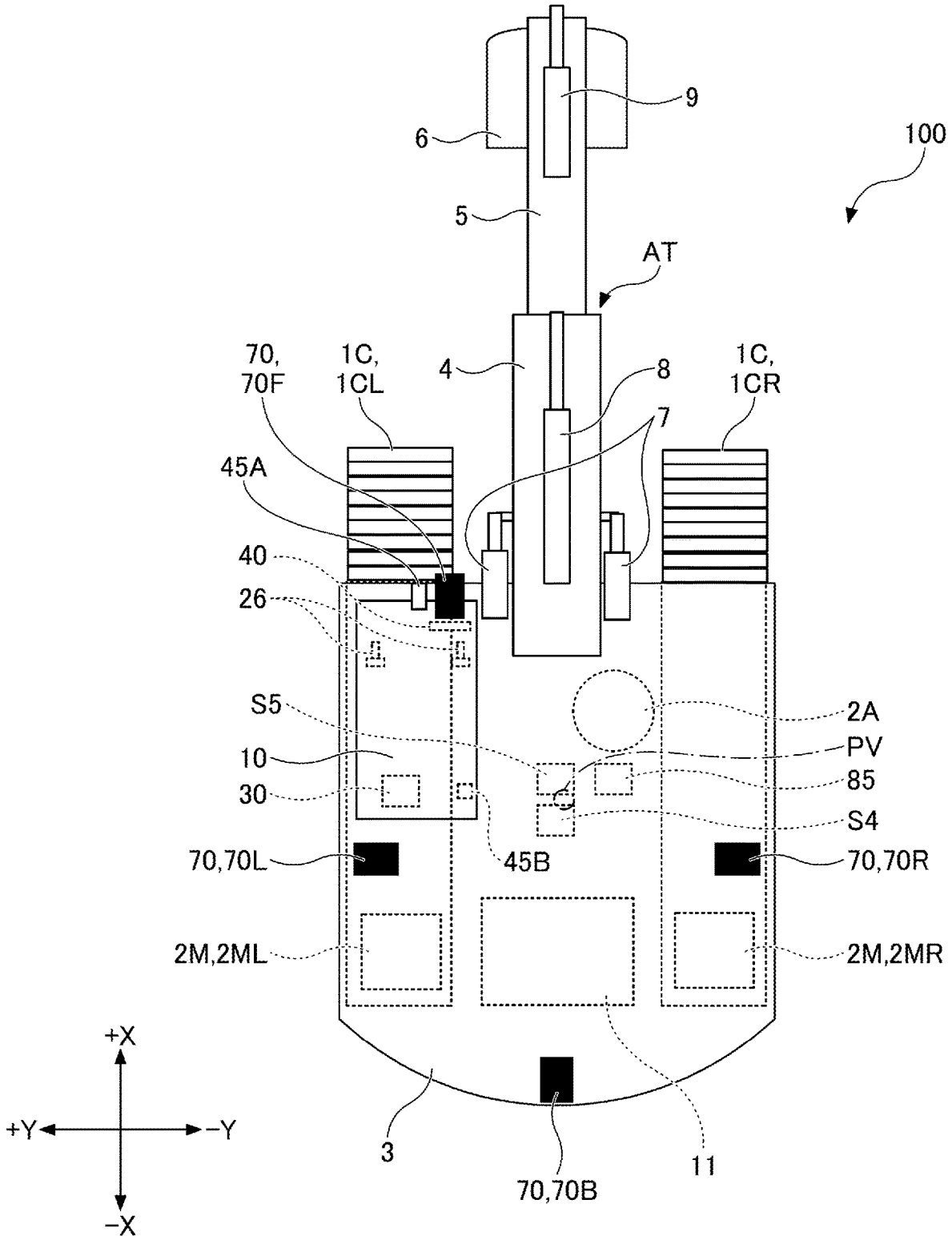
FIG. 2 is a top view of the shovel according to the embodiment of the present disclosure.

First, a shovel 100 serving as an excavator according to an embodiment of the present disclosure will be described with reference to FIG. 1 and FIG. 2. FIG. 1 is a lateral view of the shovel 100, and FIG. 2 is a top view of the shovel 100.

In the present embodiment, a lower traveling body 1 of the shovel 100 includes a crawler 1C as a driven body. The crawler 1C is driven by a traveling hydraulic motor 2M mounted in the lower traveling body 1. However, the traveling hydraulic motor 2M may be a motor generator for traveling serving as an electric actuator. Specifically, the crawler 1C includes a left crawler 1CL and a right crawler 1CR. The left crawler 1CL is driven by a left traveling hydraulic motor 2ML, and the right crawler 1CR is driven by a right traveling hydraulic motor 2MR. The lower traveling body 1 is driven by the crawler 1C and thus serves as a driven body.

An upper swiveling body 3 is swivelably mounted on the lower traveling body 1 via a swiveling mechanism 2. The swiveling mechanism 2 serving as a driven body is driven by a swiveling hydraulic motor 2A mounted in the upper swiveling body 3. However, the swiveling hydraulic motor 2A may be a motor generator for swiveling serving as an electric actuator. The upper swiveling body 3 is driven by the swiveling mechanism 2 and thus serves as a driven body.

A boom 4 serving as a driven body is attached to the upper swiveling body 3. An arm 5 serving as a driven body is attached to an end of the boom 4, and a bucket 6 serving as a driven body and an end attachment is attached to an end of the arm 5. The end attachment is a member to be attached to the end of the arm 5, and may be a breaker, a grapple, a lifting magnet, or the like. The boom 4, the arm 5, and the bucket 6 form an excavating attachment that is one example of an attachment AT. The boom 4 is driven by a boom cylinder 7, the arm 5 is driven by an arm cylinder 8, and the bucket 6 is driven by a bucket cylinder 9.

A boom angle sensor S1 is attached to the boom 4, an arm angle sensor S2 is attached to the arm 5, and a bucket angle sensor S3 is attached to the bucket 6.

The boom angle sensor S1 is configured to detect a rotation angle of the boom 4. In the present embodiment, the boom angle sensor S1 is an acceleration sensor, and can detect a boom angle that is the rotation angle of the boom 4 with respect to the upper swiveling body 3. The boom angle is, for example, the minimum angle when the boom 4 is moved down to the lowest position, and the boom angle increases as the boom 4 is raised.

The arm angle sensor S2 is configured to detect a rotation angle of the arm 5. In the present embodiment, the arm angle sensor S2 is an acceleration sensor, and can detect an arm angle that is the rotation angle of the arm 5 with respect to the boom 4. The arm angle is, for example, the minimum angle when the arm 5 is closed at most, and the arm angle increases as the arm 5 is opened.

The bucket angle sensor S3 is configured to detect a rotation angle of the bucket 6. In the present embodiment, the bucket angle sensor S3 is an acceleration sensor, and can detect a bucket angle that is the rotation angle of the bucket 6 with respect to the arm 5. The bucket angle is, for example, the minimum angle when the bucket 6 is closed at most, and the bucket angle increases as the bucket 6 is opened.

The boom angle sensor S1, the arm angle sensor S2, and the bucket angle sensor S3 may each be a potentiometer using a variable resistor, a stroke sensor that detects a stroke amount of a corresponding hydraulic cylinder, a rotary encoder that detects the rotation angle about a coupling pin, a gyro sensor, a combination of an acceleration sensor and a gyro sensor, or the like.

Also, the boom angle sensor S1 may be an operation detection part (an operation sensor 29LA described below) configured to detect the amount of operation of a boom operation lever (described below). In this case, a controller 30 may calculate a boom angle based on an output from the operation sensor 29LA. The same applies to the arm angle sensor S2 and the bucket angle sensor S3.

A cab 10, which is an operation room, is provided in the upper swiveling body 3 and a power source such as an engine 11 or the like is mounted in the upper swiveling body 3. The power source may be an electric motor. Also, an outdoor alarm 45A, a space recognition device 70, a positioning device 85, a machine body tilt sensor S4, a swivel angular velocity sensor S5, and the like are attached to the upper swiveling body 3. An operation device 26, the controller 30, a display device 40, an indoor alarm 45B, and the like are provided in the interior of the cab 10. Note in the present specification that, for the sake of convenience, an orientation of the boom 4 attached to the upper swiveling body 3 is referred to as "forward", and an orientation of a counterweight attached thereto is referred to as "backward".

The controller 30 is one example of a process circuit, and functions as a control device configured to control the shovel 100. In the present embodiment, the controller 30 is configured with a computer including: a processor such as a CPU or the like; a memory such as a RAM, a NVRAM, a ROM, or the like; and the like. The controller 30 reads out programs for functions from the ROM and loads the programs in the RAM, and causes the CPU to execute the corresponding processes. The below-described managing device (machine learning device) and the below-described shovel control device utilizing a trained model created by the managing device (machine learning device) also have a similar configuration to the configuration of the controller 30.

The controller 30 may be disposed externally of the shovel 100. Specifically, the controller 30 may be mounted in the managing device (machine learning device), such as a server or the like, mounted in an external facility, or may be mounted in an assistant device such as a laptop PC, a smartphone, or the like.

The display device 40 is configured to display image information. In the illustrated example, the display device 40 is an organic EL display, and is configured to show image information for the operator of the shovel 100.

The outdoor alarm 45A is configured to output a sound outward of the cab 10. In the illustrated example, the outdoor alarm 45A is an outdoor speaker, and is configured to output a sound for attracting attention of workers around the shovel 100.

The indoor alarm 45B is configured to output a sound inward of the cab 10. In the illustrated example, the indoor alarm 45B is an indoor speaker, and is configured to output a sound for attracting attention of the operator who operates the shovel 100.

The space recognition device 70 is configured to recognize a space around the shovel 100. The space recognition device 70 may be configured to detect an object around the shovel 100. The object is a human, an animal, a vehicle, a construction machine, a building, a hole, or the like. The space recognition device 70 is an ultrasonic sensor, a millimeter wave radar, a photographing device, an infrared sensor, or the like. The photographing device is a monocular camera, a stereo camera, a LIDAR sensor, a distance image sensor, or the like. In the present embodiment, the space recognition device 70 includes a backward camera 70B attached to the back end of the upper surface of the upper swiveling body 3, a forward camera 70F attached to the front end of the upper surface of the cab 10, a leftward camera 70L attached to the left end of the upper surface of the upper swiveling body 3, and a rightward camera 70R attached to the right end of the upper surface of the upper swiveling body 3. Note that, the space recognition device 70 may be attached to a flying object such as a multicopter or the like, may be attached to a steel tower in a working site, or may be attached to another work machine other than the shovel 100.

The space recognition device 70 may be configured to detect a predetermined object (e.g., a human) within a predetermined area that is set around the shovel 100. For example, the space recognition device 70 may be configured to separately detect a human from an object other than the human.

The positioning device 85 is configured to measure the position of the shovel 100. In the present embodiment, the positioning device 85 is a global navigation satellite system (GNSS) receiver including an electronic compass, and calculates and outputs the latitude, the longitude, and the altitude of the shovel 100 based on the received GNSS signal and calculates and outputs the orientation of the shovel 100.

The machine body tilt sensor S4 is configured to detect the tilt of the upper swiveling body 3 with respect to a predetermined flat plane. In the present embodiment, the machine body tilt sensor S4 is an acceleration sensor configured to detect the tilting angle, with respect to the horizontal surface, about the front-back axis of the upper swiveling body 3 and the tilting angle about the left-right axis of the upper swiveling body 3. For example, the front-back axis and the left-right axis of the upper swiveling body 3 are orthogonal to each other and pass through the center point of swiveling, which is a point on a swiveling axis PV of the shovel 100.

The swivel angular velocity sensor S5 is configured to detect a swiveling angular velocity of the upper swiveling body 3. In the present embodiment, the swivel angular velocity sensor S5 is a gyro sensor. The swivel angular velocity sensor S5 may be a resolver, a rotary encoder, or the like. The swivel angular velocity sensor S5 may detect a swiveling speed, a swiveling angle, or both. In this case, the swiveling speed, the swiveling angle, or both may be calculated from a swivel angular velocity.

In the following, any combination of the boom angle sensor S1, the arm angle sensor S2, the bucket angle sensor S3, the machine body tilt sensor S4, and the swivel angular velocity sensor S5 is collectively referred to also as a posture sensor.

Figure 3:
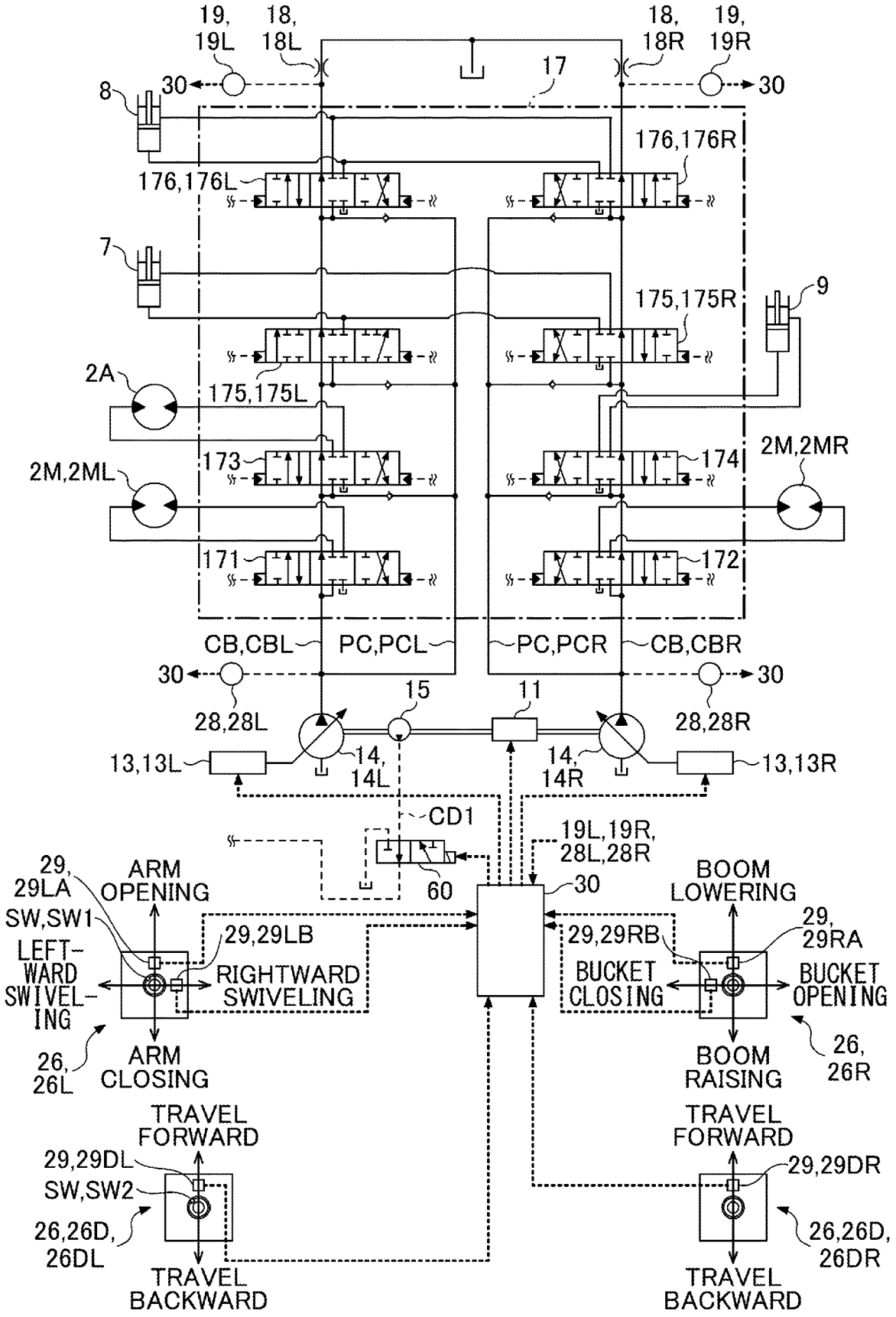
FIG. 3 is a view illustrating a configuration example of a hydraulic system mounted in the shovel.

Next, a configuration example of the hydraulic system mounted in the shovel 100 will be described with reference to FIG. 3. FIG. 3 is a view illustrating the configuration example of the hydraulic system mounted in the shovel 100. FIG. 3 illustrates a mechanical power transmission system, a hydraulic oil line, a pilot line, and an electrical control system with a double line, a solid line, a dashed line, and a dotted line, respectively.

The hydraulic system of the shovel 100 mainly includes an engine 11, a pump regulator 13, a main pump 14, a pilot pump 15, a control valve unit 17, an operation device 26, a discharge pressure sensor 28, an operation sensor 29, a controller 30, a control valve 60, and the like.

In FIG. 3, the hydraulic system circulates hydraulic oil to a hydraulic oil tank through a center bypass conduit CB or a parallel conduit PC from the main pump 14 driven by the engine 11.

The engine 11 is a driving source of the shovel 100. In the present embodiment, the engine 11 is, for example, a diesel engine that is driven so as to maintain a predetermined rotation speed. Output shafts of the engine 11 are coupled to respective input shafts of the main pump 14 and the pilot pump 15.

The main pump 14 is configured to feed hydraulic oil to the control valve unit 17 through the hydraulic oil line. In the present embodiment, the main pump 14 is a swashplate variable displacement hydraulic pump.

The pump regulator 13 is configured to control the discharge amount of the main pump 14. In the present embodiment, the pump regulator 13 controls the discharge amount (displacement) of the main pump 14 by adjusting the swashplate tilting angle of the main pump 14 in response to a control command from the controller 30.

The pilot pump 15 is configured to feed pilot oil through the pilot line to hydraulic control devices, including the operation device 26. In the present embodiment, the pilot pump 15 is a fixed displacement hydraulic pump. However, the pilot pump 15 may be omitted. In this case, the function performed by the pilot pump 15 may be achieved by the main pump 14. That is, in addition to the function of feeding the hydraulic oil to the control valve unit 17, the main pump 14 may have a function of feeding the hydraulic oil as the pilot oil to the operation device 26, an electromagnetic valve 31, and the like (see FIG. 4A to FIG. 4F) after the pressure of the hydraulic oil is lowered by a restrictor or the like.

The control valve unit 17 is a hydraulic control device configured to control the hydraulic system in the shovel 100. In the present embodiment, the control valve unit 17 includes control valves 171 to 176. The control valve 175 includes a control valve 175L and a control valve 175R, and the control valve 176 includes a control valve 176L and a control valve 176R. The control valve unit 17 can selectively feed the hydraulic oil discharged by the main pump 14 to one or more hydraulic actuators through the control valves 171 to 176. The control valves 171 to 176 control, for example, the flow rate of the hydraulic oil flowing from the main pump 14 to the hydraulic actuator and the flow rate of the hydraulic oil flowing from the hydraulic actuator to the hydraulic oil tank. The hydraulic actuator includes the boom cylinder 7, the arm cylinder 8, the bucket cylinder 9, the left traveling hydraulic motor 2ML, the right traveling hydraulic motor 2MR, and the swiveling hydraulic motor 2A.

The operation device 26 is a device that is used by an operator for operating the actuator. The actuator includes the hydraulic actuator, the electric actuator, or both. In the present embodiment, the operation device 26 feeds, through the pilot line, the pilot oil discharged by the pilot pump 15 toward the pilot port of the corresponding control valve in the control valve unit 17. The pressure (pilot pressure) of the pilot oil fed toward each of the pilot ports is a pressure in accordance with the direction and the amount of the operation of an unillustrated lever or pedal of the operation device 26 corresponding to each of the hydraulic actuators.

The discharge pressure sensor 28 is configured to detect the discharge pressure of the main pump 14. In the present embodiment, the discharge pressure sensor 28 outputs a detected value to the controller 30.

The operation sensor 29 is configured to detect an operation content of the operator using the operation device 26. In the present embodiment, the operation sensor 29 is an angle sensor configured to detect, in the form of angle, the direction and the amount of the operation of the lever or pedal of the operation device 26 corresponding to each of the actuators, and outputs a detected value to the controller 30. The operation content of the operation device 26 may be detected by another sensor other than the angle sensor.

The main pump 14 includes a left main pump 14L and a right main pump 14R. The left main pump 14L circulates the hydraulic oil to the hydraulic oil tank through a left center bypass conduit CBL or a left parallel conduit PCL, and the right main pump 14R circulates the hydraulic oil to the hydraulic oil tank through a right center bypass conduit CBR or a right parallel conduit PCR.

The left center bypass conduit CBL is a hydraulic oil line passing through the control valves 171, 173, 175L, and 176L disposed in the control valve unit 17. The right center bypass conduit CBR is a hydraulic oil line passing through the control valves 172, 174, 175R, and 176R disposed in the control valve unit 17.

The control valve 171 is a spool valve that feeds the hydraulic oil discharged by the left main pump 14L to the left traveling hydraulic motor 2ML, and switches the flow of the hydraulic oil for discharging the hydraulic oil discharged by the left traveling hydraulic motor 2ML to the hydraulic oil tank. The control valve 171 is also referred to as a "left traveling hydraulic motor control valve".

The control valve 172 is a spool valve that feeds the hydraulic oil discharged by the right main pump 14R to the right traveling hydraulic motor 2MR, and switches the flow of the hydraulic oil for discharging the hydraulic oil discharged by the right traveling hydraulic motor 2MR to the hydraulic oil tank. The control valve 172 is also referred to as a "right traveling hydraulic motor control valve".

The control valve 173 is a spool valve that feeds the hydraulic oil discharged by the left main pump 14L to the swiveling hydraulic motor 2A, and switches the flow of the hydraulic oil for discharging the hydraulic oil discharged by the swiveling hydraulic motor 2A to the hydraulic oil tank. The control valve 173 is also referred to as a "swiveling hydraulic motor control valve".

The control valve 174 is a spool valve that feeds the hydraulic oil discharged by the right main pump 14R to the bucket cylinder 9, and switches the flow of the hydraulic oil for discharging the hydraulic oil in the bucket cylinder 9 to the hydraulic oil tank. The control valve 174 is also referred to as a "bucket cylinder control valve".

The control valve 175L is a spool valve that switches the flow of the hydraulic oil for feeding the hydraulic oil discharged by the left main pump 14L to the boom cylinder 7. The control valve 175R is a spool valve that feeds the hydraulic oil discharged by the right main pump 14R to the boom cylinder 7, and switches the flow of the hydraulic oil for discharging the hydraulic oil in the boom cylinder 7 to the hydraulic oil tank. The control valve 175 is also referred to as a "boom cylinder control valve".

The control valve 176L is a spool valve that feeds the hydraulic oil discharged by the left main pump 14L to the arm cylinder 8, and switches the flow of the hydraulic oil for discharging the hydraulic oil in the arm cylinder 8 to the hydraulic oil tank. The control valve 176R is a spool valve that feeds the hydraulic oil discharged by the right main pump 14R to the arm cylinder 8, and switches the flow of the hydraulic oil for discharging the hydraulic oil in the arm cylinder 8 to the hydraulic oil tank. The control valve 176 is also referred to as an "arm cylinder control valve".

The left parallel conduit PCL is a hydraulic oil line parallel to the left center bypass conduit CBL. The left parallel conduit PCL can feed the hydraulic oil to a downstream control valve when the flow of the hydraulic oil passing through the left center bypass conduit CBL is restricted or blocked by the control valve 171, 173, or 175L. The right parallel conduit PCR is a hydraulic oil line parallel to the right center bypass conduit CBR. The right parallel conduit PCR can feed the hydraulic oil to a downstream control valve when the flow of the hydraulic oil passing through the right center bypass conduit CBR is restricted or blocked by the control valve 172, 174, or 175R.

The pump regulator 13 includes a left pump regulator 13L and a right pump regulator 13R. The left pump regulator 13L controls the discharge amount (displacement) of the left main pump 14L by adjusting the swashplate tilting angle of the left main pump 14L in accordance with the discharge pressure of the left main pump 14L. Specifically, the left pump regulator 13L, for example, adjusts the swashplate tilting angle of the left main pump 14L in accordance with an increase in the discharge pressure of the left main pump 14L to reduce the discharge amount (displacement). The same applies to the right pump regulator 13R. This is to prevent absorption power (absorption horsepower) of the main pump 14, which is represented as a product of the discharge pressure and the discharge amount, from exceeding output power (output horsepower) of the engine 11.

The operation device 26 includes a left operation lever 26L, a right operation lever 26R, and a traveling lever 26D. The traveling lever 26D includes a left traveling lever 26DL and a right traveling lever 26DR.

The left operation lever 26L is used for the swivel operation and the operation of the arm 5. The left operation lever 26L, when operated in the forward and backward directions, utilizes the pilot oil discharged by the pilot pump 15 to introduce a control pressure in accordance with the amount of the operation to the pilot port of the control valve 176. When the left operation lever 26L is operated in the leftward and rightward directions, the pilot oil discharged by the pilot pump 15 is used to introduce the control pressure in accordance with the amount of the operation to the pilot port of the control valve 173.

Specifically, the left operation lever 26L introduces the pilot oil to the right pilot port of the control valve 176L and introduces the pilot oil to the left pilot port of the control valve 176R when operated in an arm closing direction. The left operation lever 26L, when operated in an arm opening direction, introduces the pilot oil to the left pilot port of the control valve 176L and introduces the pilot oil to the right pilot port of the control valve 176R. The left operation lever 26L introduces the pilot oil to the left pilot port of the control valve 173 when operated in a leftward swiveling direction and introduces the pilot oil to the right pilot port of the control valve 173 when operated in a rightward swiveling direction. In this way, the left operation lever 26L functions as an "arm operation lever" when operated in the forward and backward directions, and functions as a "swiveling operation lever" when operated in the leftward and rightward directions.

The right operation lever 26R is used to operate the boom 4 and the bucket 6. The right operation lever 26R utilizes the pilot oil discharged by the pilot pump 15 when operated in the forward and backward directions to introduce a control pressure in accordance with the amount of the operation to the pilot port of the control valve 175. When the right operation lever 26R is operated in the leftward and rightward directions, the pilot oil discharged by the pilot pump 15 is used to introduce the control pressure in accordance with the amount of the operation to the pilot port of the control valve 174.

Specifically, the right operation lever 26R introduces the pilot oil to the right pilot port of the control valve 175R when operated in the boom lowering direction. The right operation lever 26R, when operated in the boom raising direction, introduces the pilot oil to the right pilot port of the control valve 175L and introduces the pilot oil to the left pilot port of the control valve 175R. The right operation lever 26R introduces the pilot oil to the right pilot port of the control valve 174 when operated in the bucket closing direction, and introduces the pilot oil to the left pilot port of the control valve 174 when operated in a bucket opening direction. In this way, the right operation lever 26R functions as a "boom operation lever" when operated in the forward and backward directions, and functions as a "bucket operation lever" when operated in the leftward and rightward directions.

The traveling lever 26D is used to operate the crawler 1C. Specifically, the left traveling lever 26DL is used to operate the left crawler 1CL. The left traveling lever 26DL may be configured to interlock with a left traveling pedal. The left traveling lever 26DL, when operated in the forward and backward directions, utilizes the pilot oil discharged by the pilot pump 15 to introduce the control pressure in accordance with the amount of the operation to the pilot port of the control valve 171. The right traveling lever 26DR is used to operate the right crawler 1CR. The right traveling lever 26DR may be configured to interlock with a right traveling pedal. The right traveling lever 26DR, when operated in the forward and backward directions, utilizes the pilot oil discharged by the pilot pump 15 to introduce the control pressure in accordance with the amount of the operation to the pilot port of the control valve 172.

The discharge pressure sensor 28 includes a left discharge pressure sensor 28L and a right discharge pressure sensor 28R. The right discharge pressure sensor 28L detects the discharge pressure of the left main pump 14L and outputs a detected value to the controller 30. The same applies to the right discharge pressure sensor 28R.

The operation sensor 29 includes operation sensors 29LA, 29LB, 29RA, 29RB, 29DL, and 29DR. The operation sensor 29LA detects, in the form of angle, the content of the operation in the forward and backward directions by the operator relative to the left operation lever 26L and outputs a detected value to the controller 30. The content of the operation is, for example, the direction of the lever operation and the amount of the lever operation (angle of the lever operation). Similarly, the operation sensor 29LB detects, in the form of angle, the content of the operation by the operator in the leftward and rightward directions relative to the left operation lever 26L and outputs a detected value to the controller 30. The operation sensor 29RA detects, in the form of angle, the content of the operation by the operator in the forward and backward directions relative to the right operation lever 26R and outputs a detected value to the controller 30. The operation sensor 29RB detects, in the form of angle, the content of the operation by the operator in the leftward and rightward directions relative to the right operation lever 26R and outputs a detected value to the controller 30. The operation sensor 29DL detects, in the form of angle, the content of the operation by the operator in the forward and backward directions relative to the left traveling lever 26DL and outputs a detected value to the controller 30. The operation sensor 29DR detects, in the form of angle, the content of the operation by the operator in the forward and backward directions relative to the right traveling lever 26DR and outputs a detected value to the controller 30.

The controller 30 receives the output from the operation sensor 29 and outputs a control command to the pump regulator 13 as needed to change the discharge amount of the main pump 14.

Here, a negative-control regulation using a restrictor 18 and a control pressure sensor 19 will be described. The restrictor 18 includes a left restrictor 18L and a right restrictor 18R, and the control pressure sensor 19 includes a left control pressure sensor 19L and a right control pressure sensor 19R.

In the left center bypass conduit CBL, the left restrictor 18L is disposed between the control valve 176L, which is located the most downstream, and the hydraulic oil tank. Therefore, the flow of hydraulic oil discharged by the left main pump 14L is limited by the left restrictor 18L. The left restrictor 18L generates a control pressure for controlling the left pump regulator 13L. The left control pressure sensor 19L is a sensor for detecting this control pressure and outputs a detected value to the controller 30. The controller 30 controls the discharge amount of the left main pump 14L by adjusting the tilting angle of the swashplate of the left main pump 14L in accordance with the control pressure. The controller 30 decreases the discharge amount of the left main pump 14L as the control pressure increases, and increases the discharge amount of the left main pump 14L as the control pressure decreases. The discharge amount of the right main pump 14R is controlled in the same manner.

Specifically, when none of the hydraulic actuators of the shovel 100 is in the standby state as illustrated in FIG. 3, the hydraulic oil discharged by the left main pump 14L passes through the left center bypass conduit CBL and reaches the left restrictor 18L. The flow of the hydraulic oil discharged by the left main pump 14L increases the control pressure generated upstream of the left restrictor 18L. As a result, the controller 30 reduces the discharge amount from the left main pump 14L to the allowable minimum discharge amount and suppresses the pressure loss (pumping loss) when the discharged hydraulic oil passes through the left center bypass conduit CBL. On the other hand, when any of the hydraulic actuators is operated, the hydraulic oil discharged by the left main pump 14L flows into the hydraulic actuator to be operated through a control valve corresponding to the hydraulic actuator to be operated. The flow of the hydraulic oil discharged by the left main pump 14L decreases or extinguishes the amount reaching the left restrictor 18L, thereby reducing the control pressure generated upstream of the left restrictor 18L. As a result, the controller 30 increases the discharge rate of the left main pump 14L to introduce sufficient hydraulic oil to the hydraulic actuator to be operated to ensure drive of the hydraulic actuator to be operated. The controller 30 controls the discharge amount of the right main pump 14R in the same manner.

With the above-described configuration, the hydraulic system of FIG. 3 can reduce wasteful energy consumption at the main pump 14 in standby conditions. The wasteful energy consumption includes pumping losses caused by the hydraulic oil discharged by the main pump 14 in the center bypass conduit CB. The hydraulic system of FIG. 3 ensures that when the hydraulic actuator is operated, sufficient hydraulic fluid is fed from the main pump 14 to the hydraulic actuator to be actuated.

The control valve 60 is configured to perform switching between an effective state and an ineffective state of the operation device 26. The effective state of the operation device 26 is a state where the operator operates the operation device 26 and can move the driven body of interest. The ineffective state of the operation device 26 is a state where the operator operates the operation device 26 but cannot move the driven body of interest.

In the present embodiment, the control valve 60 is an electromagnetic valve configured to perform switching between a communicating state and a blocking state of a pilot line CD1 connecting the pilot pump 15 and the operation device 26 to each other. Specifically, the control valve 60 is configured to perform switching between the communicating state and the blocking state of the pilot line CD1 in accordance with a command from the controller 30.

The control valve 60 may be configured to interlock with an unillustrated gate lock lever. Specifically, the control valve 60 may be configured so that when the gate lock lever is pressed downward, the pilot line CD1 is turned into the blocking state, and when the gate lock lever is pulled upward, the pilot line CD1 is turned into the communicating state. However, the control valve 60 may be another electromagnetic valve different from the electromagnetic valve configured to perform switching between the communicating state and the blocking state of the pilot line CD1 with interlocking with the gate lock lever.

Figure 4A:
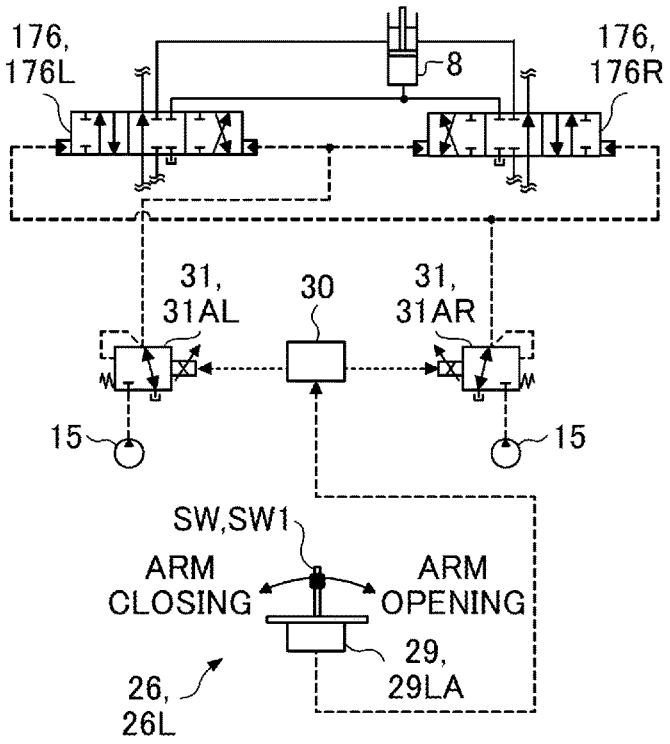
FIG. 4A is a partial view of the hydraulic system in relation to an operation of an arm cylinder.
Figure 4B:
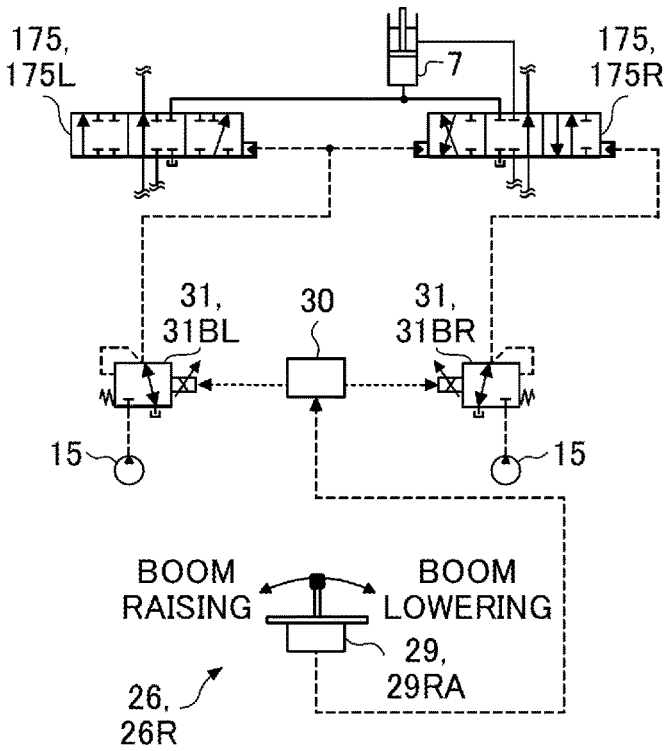
FIG. 4B is a partial view of the hydraulic system in relation to an operation of a boom cylinder.
Figure 4C:
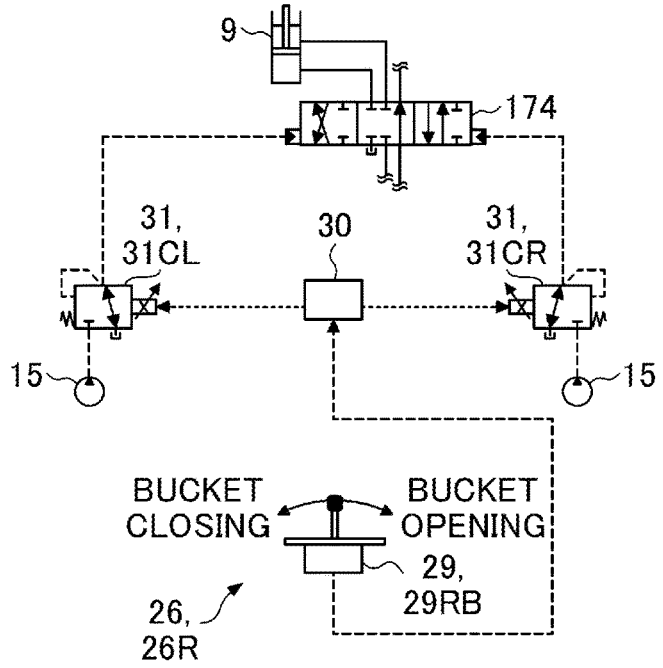
FIG. 4C is a partial view of the hydraulic system in relation to an operation of a bucket cylinder.
Figure 4D:
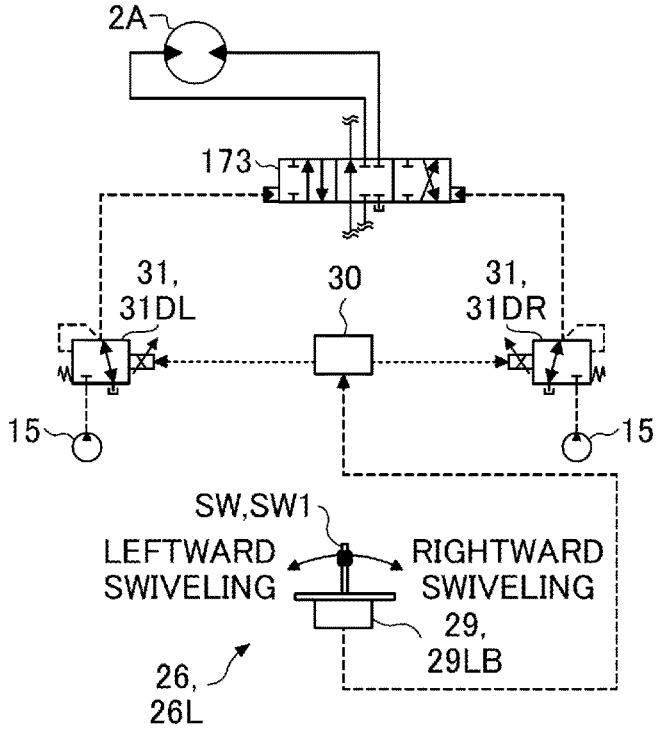
FIG. 4D is a partial view of the hydraulic system in relation to an operation of a swiveling hydraulic motor.
Figure 4E:
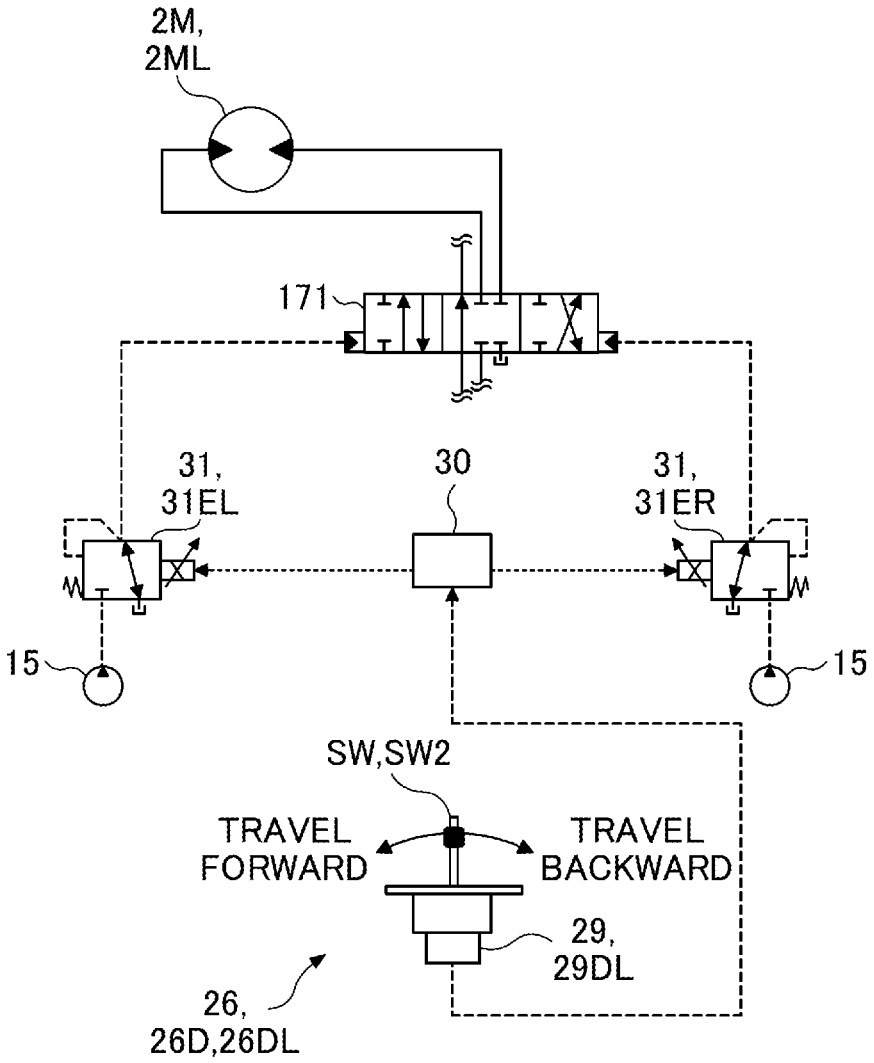
FIG. 4E is a partial view of the hydraulic system in relation to an operation of a left traveling hydraulic motor.
Figure 4F:
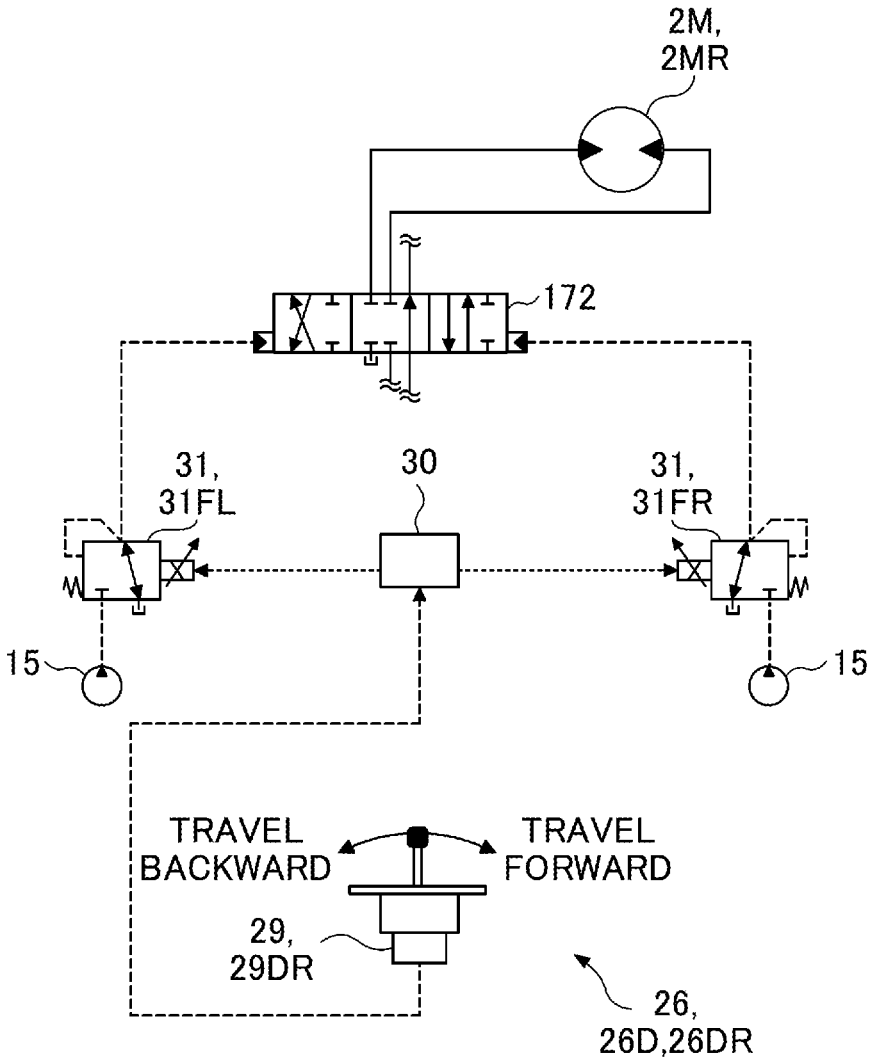
FIG. 4F is a partial view of the hydraulic system in relation to an operation of a right traveling hydraulic motor.

Next, a configuration for the controller 30 to move the actuators will be described with reference to FIG. 4A to FIG. 4F. FIG. 4A to FIG. 4F are views of parts extracted from the hydraulic system. Specifically, FIG. 4A is a view of a part extracted from the hydraulic system in relation to the operation of the arm cylinder 8. FIG. 4B is a view of a part extracted from the hydraulic system in relation to the operation of the boom cylinder 7. FIG. 4C is a view of a part extracted from the hydraulic system in relation to the operation of the bucket cylinder 9. FIG. 4D is a view of a part extracted from the hydraulic system in relation to the operation of the swiveling hydraulic motor 2A. FIG. 4E is a view of a part extracted from the hydraulic system in relation to the operation of the left traveling hydraulic motor 2ML. FIG. 4F is a view of a part extracted from the hydraulic system in relation to the operation of the right traveling hydraulic motor 2MR.

As illustrated in FIG. 4A to FIG. 4F, the hydraulic system includes the electromagnetic valve 31. The electromagnetic valve 31 includes an electromagnetic valve 31AL to an electromagnetic valve 31FL and an electromagnetic valve 31AR to an electromagnetic valve 31FR.

The electromagnetic valve 31 is disposed in a conduit connecting the pilot pump 15 to the pilot port of the corresponding control valve in the control valve unit 17. The electromagnetic valve 31 is configured to change the flow path area of the conduit by changing the opening area thereof. In the present embodiment, the electromagnetic valve 31 is an electromagnetic proportional valve, and moves in response to a control command output by the controller 30. Thus, the controller 30 can feed the pilot oil discharged by the pilot pump 15 to the pilot port of the corresponding control valve in the control valve unit 17 through the electromagnetic valve 31, in response to the operation of the operation device 26 by the operator or regardless of the operation of the operation device 26 by the operator. The controller 30 can apply a pilot pressure generated by the electromagnetic valve 31 to the pilot port of the corresponding control valve.

With this configuration, even if no operation is being performed on the specific operation device 26 in addition to when the operation is being performed on the specific operation device 26, the controller 30 can operate the hydraulic actuator corresponding to the specific operation device 26. Also, even if an operation is being performed on the specific operation device 26, the controller 30 can forcibly stop the operation of the hydraulic actuator corresponding to the specific operation device 26.

For example, as illustrated in FIG. 4A, the left operation lever 26L is used to operate the arm 5. Specifically, the left operation lever 26L utilizes the pilot oil discharged by the pilot pump 15 to apply a pilot pressure to the pilot port of the control valve 176 in response to the operation in the forward and backward directions. More specifically, the left operation lever 26L, when operated in the arm closing direction (backward direction), applies a pilot pressure in accordance with the operation amount to the right pilot port of the control valve 176L and the left pilot port of the control valve 176R. The left operation lever 26L, when operated in the arm opening direction (forward direction), applies a pilot pressure in accordance with the operation amount to the left pilot port of the control valve 176L and the right pilot port of the control valve 176R.

The operation device 26 is provided with a switch SW. In the present embodiment, the switch SW includes a switch SW1 and a switch SW2. The switch SW1 is a push-button switch provided at the end of the left operation lever 26L. The operator can operate the left operation lever 26L while pressing the switch SW1. The switch SW1 may be provided at the right operation lever 26R or at other locations within the cab 10. The switch SW2 is a push-button switch provided at the end of the left traveling lever 26DL. The operator can operate the left traveling lever 26DL while pressing the switch SW2. The switch SW2 may be provided at the right traveling lever 26DR or at other locations within the cab 10.

The operation sensor 29LA detects the content of the operation in the forward and backward directions by the operator relative to the left operation lever 26L and outputs a detected value to the controller 30.

The electromagnetic valve 31AL operates in response to a control command (electric current command) output by the controller 30, thereby adjusting the pilot pressure of the pilot oil introduced from the pilot pump 15 to the right pilot port of the control valve 176L and the left pilot port of the control valve 176R through the electromagnetic valve 31AL. The electromagnetic valve 31AR operates in response to a control command (electric current command) output by the controller 30, thereby adjusting the pilot pressure of the pilot oil introduced from the pilot pump 15 to the left pilot port of the control valve 176L and the right pilot port of the control valve 176R through the electromagnetic valve 31AR. The electromagnetic valve 31AL can adjust the pilot pressure so that the control valve 176L and the control valve 176R can be stopped at a given valve position. Similarly, the electromagnetic valve 31AR can adjust the pilot pressure so that the control valve 176L and the control valve 176R can be stopped at a given valve position.

With this configuration, the controller 30 can feed the pilot oil discharged by the pilot pump 15 to the right pilot port of the control valve 176L and the left pilot port of the control valve 176R through the electromagnetic valve 31AL in response to the arm closing operation by the operator. Also, the controller 30 can feed the pilot oil discharged by the pilot pump 15 to the right pilot port of the control valve 176L and the left pilot port of the control valve 176R through the electromagnetic valve 31AL regardless of the arm closing operation by the operator. That is, the controller 30 can close the arm 5 in response to the arm closing operation by the operator or regardless of the arm closing operation by the operator. In this way, the electromagnetic valve 31AL functions as an "arm electromagnetic valve" or an "arm closing electromagnetic valve".

Also, the controller 30 can feed the pilot oil discharged by the pilot pump 15 to the left pilot port of the control valve 176L and the right pilot port of the control valve 176R through the electromagnetic valve 31AR in response to the arm opening operation by the operator. Also, the controller 30 can feed the pilot oil discharged by the pilot pump 15 to the left pilot port of the control valve 176L and the right pilot port of the control valve 176R through the electromagnetic valve 31AR regardless of the arm opening operation by the operator. That is, the controller 30 can open the arm 5 in response to the arm opening operation by the operator or regardless of the arm opening operation by the operator. In this way, the electromagnetic valve 31AR functions as an "arm electromagnetic valve" or an "arm opening electromagnetic valve".

With this configuration, even if the arm closing operation is being performed by the operator, the controller 30, as needed, can reduce the pilot pressure applied to the pilot port on the closing side of the control valve 176 (the left pilot port of the control valve 176L and the right pilot port of the control valve 176R) and forcibly stop the closing movement of the arm 5. The same applies to the case of forcibly stopping the opening movement of the arm 5 when the arm opening operation is performed by the operator.

Alternatively, even if the arm closing operation is being performed by the operator, the controller 30, as needed, may forcibly stop the closing movement of the arm 5 by controlling the electromagnetic valve 31AR to increase the pilot pressure applied to the pilot port on the opening side of the control valve 176, which is located opposite to the pilot port on the closing side of the control valve 176, (the right pilot port of the control valve 176L and the left pilot port of the control valve 176R), thereby forcibly returning the control valve 176 to a neutral position. The same applies to the case of forcibly stopping the opening movement of the arm 5 when the arm opening operation is performed by the operator.

Although description with reference to FIG. 4B to FIG. 4F is omitted in the following, the same applies to: the case of forcibly stopping the movement of the boom 4 when a boom raising operation or a boom lowering operation is being performed by the operator; the case of forcibly stopping the movement of the bucket 6 when a bucket closing operation or a bucket opening operation is being performed by the operator; and the case of forcibly stopping the swiveling movement of the upper swiveling body 3 when a swiveling operation is being performed by the operator. Also, the same applies to the case of forcibly stopping a traveling movement of the lower traveling body 1 when a traveling operation is being performed by the operator.

Also, the controller 30 may be configured to apply a low pilot pressure to the pilot ports at both sides of the control valve 176 before performing the arm operation in order to better responsiveness of the arm operation (arm closing operation and arm opening operation). The same applies to other operations such as the boom operation (boom raising operation and boom lowering operation) and the like. That is, the controller 30 can increase responsiveness of the hydraulic actuators by using a larger amount of the pilot oil.

Also, as illustrated in FIG. 4B, the right operation lever 26R is used to operate the boom 4. Specifically, the right operation lever 26R utilizes the pilot oil discharged by the pilot pump 15 to apply a pilot pressure to the pilot port of the control valve 175 in response to the operation in the forward and backward directions. More specifically, the right operation lever 26R, when operated in a boom raising direction (backward direction), applies a pilot pressure in accordance with the operation amount to the right pilot port of the control valve 175L and the left pilot port of the control valve 175R. The right operation lever 26R, when operated in a boom lowering direction (forward direction), applies a pilot pressure in accordance with the operation amount to the right pilot port of the control valve 175R.

The operation sensor 29RA detects the content of the operation in the forward and backward directions by the operator relative to the right operation lever 26R and outputs a detected value to the controller 30.

The electromagnetic valve 31BL operates in response to a control command (electric current command) output by the controller 30, thereby adjusting the pilot pressure of the pilot oil introduced from the pilot pump 15 to the right pilot port of the control valve 175L and the left pilot port of the control valve 175R through the electromagnetic valve 31BL. The electromagnetic valve 31BR operates in response to a control command (electric current command) output by the controller 30, thereby adjusting the pilot pressure of the pilot oil introduced from the pilot pump 15 to the right pilot port of the control valve 175R through the electromagnetic valve 31BR. The electromagnetic valve 31BL can adjust the pilot pressure so that the control valve 175L and the control valve 175R can be stopped at a given valve position. Also, the electromagnetic valve 31BR can adjust the pilot pressure so that the control valve 175R can be stopped at a given valve position.

With this configuration, the controller 30 can feed the pilot oil discharged by the pilot pump 15 to the right pilot port of the control valve 175L and the left pilot port of the control valve 175R through the electromagnetic valve 31BL in response to the boom raising operation by the operator. Also, the controller 30 can feed the pilot oil discharged by the pilot pump 15 to the right pilot port of the control valve 175L and the left pilot port of the control valve 175R through the electromagnetic valve 31BL regardless of the boom raising operation by the operator. That is, the controller 30 can raise the boom 4 in response to the boom raising operation by the operator or regardless of the boom raising operation by the operator. In this way, the electromagnetic valve 31BL functions as a "boom electromagnetic valve" or a "boom raising electromagnetic valve".

Also, the controller 30 can feed the pilot oil discharged by the pilot pump 15 to the right pilot port of the control valve 175R through the electromagnetic valve 31BR in response to the boom lowering operation by the operator. Also, the controller 30 can feed the pilot oil discharged by the pilot pump 15 to the right pilot port of the control valve 175R through the electromagnetic valve 31BR regardless of the boom lowering operation by the operator. That is, the controller 30 can lower the boom 4 in response to the boom lowering operation by the operator or regardless of the boom lowering operation by the operator. In this way, the electromagnetic valve 31BR functions as a "boom electromagnetic valve" or a "boom lowering electromagnetic valve".

As illustrated in FIG. 4C, the right operation lever 26R is used to operate the bucket 6. Specifically, the right operation lever 26R utilizes the pilot oil discharged by the pilot pump 15 to apply a pilot pressure to the pilot port of the control valve 174 in response to the operation in the leftward and rightward directions. More specifically, the right operation lever 26R, when operated in the bucket closing direction (leftward direction), applies a pilot pressure in accordance with the operation amount to the left pilot port of the control valve 174. The right operation lever 26R, when operated in the bucket opening direction (rightward direction), applies a pilot pressure in accordance with the operation amount to the right pilot port of the control valve 174.

The operation sensor 29RB detects the content of the operation in the leftward and rightward directions by the operator relative to the right operation lever 26R and outputs a detected value to the controller 30.

The electromagnetic valve 31CL operates in response to a control command (electric current command) output by the controller 30, thereby adjusting the pilot pressure of the pilot oil introduced from the pilot pump 15 to the left pilot port of the control valve 174 through the electromagnetic valve 31CL. The electromagnetic valve 31CR operates in response to a control command (electric current command) output by the controller 30, thereby adjusting the pilot pressure of the pilot oil introduced from the pilot pump 15 to the right pilot port of the control valve 174 through the electromagnetic valve 31CR. The electromagnetic valve 31CL can adjust the pilot pressure so that the control valve 174 can be stopped at a given valve position. Similarly, the electromagnetic valve 31CR can adjust the pilot pressure so that the control valve 174 can be stopped at a given valve position.

With this configuration, the controller 30 can feed the pilot oil discharged by the pilot pump 15 to the left pilot port of the control valve 174 through the electromagnetic valve 31CL in response to the bucket closing operation by the operator. Also, the controller 30 can feed the pilot oil discharged by the pilot pump 15 to the left pilot port of the control valve 174 through the electromagnetic valve 31CL regardless of the bucket closing operation by the operator. That is, the controller 30 can close the bucket 6 in response to the bucket closing operation by the operator or regardless of the bucket closing operation by the operator. In this way, the electromagnetic valve 31CL functions as a "bucket electromagnetic valve" or a "bucket closing electromagnetic valve".

Also, the controller 30 can feed the pilot oil discharged by the pilot pump 15 to the right pilot port of the control valve 174 through the electromagnetic valve 31CR in response to the bucket opening operation by the operator. Also, the controller 30 can feed the pilot oil discharged by the pilot pump 15 to the right pilot port of the control valve 174 through the electromagnetic valve 31CR regardless of the bucket opening operation by the operator. That is, the controller 30 can open the bucket 6 in response to the bucket opening operation by the operator or regardless of the bucket opening operation by the operator. In this way, the electromagnetic valve 31CR functions as a "bucket electromagnetic valve" or a "bucket opening electromagnetic valve".

As illustrated in FIG. 4D, the left operation lever 26L is used to operate the swiveling mechanism 2. Specifically, the left operation lever 26L utilizes the pilot oil discharged by the pilot pump 15 to apply a pilot pressure to the pilot port of the control valve 173 in response to the operation in the leftward and rightward directions. More specifically, the left operation lever 26L, when operated in the leftward swiveling direction (leftward direction), applies a pilot pressure in accordance with the operation amount to the left pilot port of the control valve 173. The left operation lever 26L, when operated in the rightward swiveling direction (rightward direction), applies a pilot pressure in accordance with the operation amount to the right pilot port of the control valve 173.

The operation sensor 29LB detects the content of the operation in the leftward and rightward directions by the operator relative to the left operation lever 26L and outputs a detected value to the controller 30.

The electromagnetic valve 31DL operates in response to a control command (electric current command) output by the controller 30, thereby adjusting the pilot pressure of the pilot oil introduced from the pilot pump 15 to the left pilot port of the control valve 173 through the electromagnetic valve 31DL. The electromagnetic valve 31DR operates in response to a control command (electric current command) output by the controller 30, thereby adjusting the pilot pressure of the pilot oil introduced from the pilot pump 15 to the right pilot port of the control valve 173 through the electromagnetic valve 31DR. The electromagnetic valve 31DL can adjust the pilot pressure so that the control valve 173 can be stopped at a given valve position. Similarly, the electromagnetic valve 31DR can adjust the pilot pressure so that the control valve 173 can be stopped at a given valve position.

With this configuration, the controller 30 can feed the pilot oil discharged by the pilot pump 15 to the left pilot port of the control valve 173 through the electromagnetic valve 31DL in response to the leftward swiveling operation by the operator. Also, the controller 30 can feed the pilot oil discharged by the pilot pump 15 to the left pilot port of the control valve 173 through the electromagnetic valve 31DL regardless of the leftward swiveling operation by the operator. That is, the controller 30 can swivel the swiveling mechanism 2 leftward in response to the leftward swiveling operation by the operator or regardless of the leftward swiveling operation by the operator. In this way, the electromagnetic valve 31DL functions as a "swiveling electromagnetic valve" or a "leftward swiveling electromagnetic valve".

Also, the controller 30 can feed the pilot oil discharged by the pilot pump 15 to the right pilot port of the control valve 173 through the electromagnetic valve 31DR in response to the rightward swiveling operation by the operator. Also, the controller 30 can feed the pilot oil discharged by the pilot pump 15 to the right pilot port of the control valve 173 through the electromagnetic valve 31DR regardless of the rightward swiveling operation by the operator. That is, the controller 30 can swivel the swiveling mechanism 2 rightward in response to the rightward swiveling operation by the operator or regardless of the rightward swiveling operation by the operator. In this way, the electromagnetic valve 31DR functions as a "swiveling electromagnetic valve" or a "rightward swiveling electromagnetic valve".

Also, as illustrated in FIG. 4E, the left traveling lever 26DL is used to operate the left crawler 1CL. Specifically, the left traveling lever 26DL utilizes the pilot oil discharged by the pilot pump 15 to apply a pilot pressure in accordance with the operation in the forward and backward directions to the pilot port of the control valve 171. More specifically, the left traveling lever 26DL, when operated in the traveling forward direction (forward direction), applies the pilot pressure in accordance with the operation amount to the left pilot port of the control valve 171. Also, the left traveling lever 26DL, when operated in the backward traveling direction (backward direction), applies the pilot pressure in accordance with the operation amount to the right pilot port of the control valve 171.

The operation sensor 29DL electrically detects the content of the operation by the operator in the forward and backward directions relative to the left traveling lever 26DL and outputs a detected value to the controller 30.

The electromagnetic valve 31EL operates in response to an electric current command output by the controller 30. The electromagnetic valve 31EL adjusts the pilot pressure of the pilot oil introduced from the pilot pump 15 to the left pilot port of the control valve 171 through the electromagnetic valve 31EL. The electromagnetic valve 31ER operates in response to an electric current command output by the controller 30. The electromagnetic valve 31ER adjusts the pilot pressure of the pilot oil introduced from the pilot pump 15 to the right pilot port of the control valve 171 through the electromagnetic valve 31ER. The electromagnetic valves 31EL and 31ER can adjust the pilot pressure so that the control valve 171 can be stopped at a given valve position.

With this configuration, the controller 30 can feed the pilot oil discharged by the pilot pump 15 to the left pilot port of the control valve 171 through the electromagnetic valve 31EL regardless of the forward left traveling operation by the operator. That is, the left crawler 1CL can be caused to travel forward. Also, the controller 30 can feed the pilot oil discharged by the pilot pump 15 to the right pilot port of the control valve 171 through the electromagnetic valve 31ER regardless of the left traveling backward operation by the operator. That is, the left crawler 1CL can be caused to travel backward. In this way, the electromagnetic valve 31EL functions as a "left traveling electromagnetic valve" or a "left forward traveling electromagnetic valve", and the electromagnetic valve 31ER functions as a "left traveling electromagnetic valve" or a "left backward traveling electromagnetic valve".

Also, as illustrated in FIG. 4F, the right traveling lever 26DR is used to operate the right crawler 1CR. Specifically, the right traveling lever 26DR utilizes the pilot oil discharged by the pilot pump 15 to apply a pilot pressure in accordance with the operation in the forward and backward directions to the pilot port of the control valve 172. More specifically, the right traveling lever 26DR, when operated in the traveling forward direction (forward direction), applies the pilot pressure in accordance with the operation amount to the right pilot port of the control valve 172. Also, the right traveling lever 26DR, when operated in the backward traveling direction (the backward direction), applies the pilot pressure in accordance with the operation amount to the right pilot port of the control valve 172.

The operation sensor 29DR electrically detects the content of the operation by the operator in the forward and backward directions relative to the right traveling lever 26DR and outputs a detected value to the controller 30.

The electromagnetic valve 31FL operates in response to an electric current command output by the controller 30. The electromagnetic valve 31FL adjusts the pilot pressure of the pilot oil introduced from the pilot pump 15 to the left pilot port of the control valve 172 through the electromagnetic valve 31FL. The electromagnetic valve 31FR operates in response to an electric current command output by the controller 30. The electromagnetic valve 31FR adjusts the pilot pressure of the pilot oil introduced from the pilot pump 15 to the right pilot port of the control valve 172 through the electromagnetic valve 31FR. The electromagnetic valves 31FL and 31FR can adjust the pilot pressure so that the control valve 172 can be stopped at a given valve position.

With this configuration, the controller 30 can feed the pilot oil discharged by the pilot pump 15 to the right pilot port of the control valve 172 through the electromagnetic valve 31FL regardless of the forward right traveling operation by the operator. That is, the right crawler 1CR can be caused to travel forward. Also, the controller 30 can feed the pilot oil discharged by the pilot pump 15 to the left pilot port of the control valve 172 through the electromagnetic valve 31FR regardless of the right traveling backward operation by the operator. That is, the right crawler 1CR can be caused to travel backward. In this way, the electromagnetic valve 31FL functions as a "right traveling electromagnetic valve" or a "right forward traveling electromagnetic valve", and the electromagnetic valve 31FR functions as a "right traveling electromagnetic valve" or a "right backward traveling electromagnetic valve".

Also, the shovel 100 may include a structure configured to automatically operate a bucket tilt mechanism. In this case, a part of the hydraulic system in relation to a bucket tilt cylinder forming the bucket tilt mechanism may be configured in the same manner as in, for example, the part of the hydraulic system in relation to the operation of the boom cylinder 7.

Although the operation device 26 that is an electric operation lever has been described, the operation device 26 may be a hydraulic operation lever rather than the electric operation lever. In this case, the amount of the operation of the hydraulic operation lever may be detected by a pressure sensor in the form of pressure and input to the controller 30. Also, an electromagnetic valve may be disposed between the operation device 26 that is the hydraulic operation lever, and the pilot port of each of the control valves. The electromagnetic valve is configured to operate in response to an electric signal from the controller 30. With this configuration, in response to manually operating the operation device 26 that is the hydraulic operation lever, the operation device 26 increases or decreases a pilot pressure in accordance with the amount of the operation, thereby moving each of the control valves. Also, each of the control valves may be configured with an electromagnetic spool valve. In this case, the electromagnetic spool valve operates in response to an electric signal from the controller 30 corresponding to the amount of the operation of the electric operation lever.

Next, overviews of a machine guidance function and a machine control function of the shovel 100 will be described. The controller 30 may be configured to perform the machine guidance function of guiding manual operations of the shovel 100 by the operator.

In the present embodiment, the controller 30 is configured to perform the machine guidance function (releasing movement guiding function) of guiding a movement (one example of the releasing movement) for releasing the earth and sand taken in the bucket 6 by an excavating movement to a position (target releasing position) other than the excavating position. The releasing movement is a series of movements including at least the swiveling movement and end attachment movements such as a bucket opening movement and the like. When an object to be released is, for example, soil, or earth and sand, the releasing movement is also referred to as a "soil releasing movement", a "soil discharging movement", or a "dumping movement". Also, the releasing movement may include a boom raising movement, a boom lowering movement, an arm closing movement, an arm opening movement, a bucket closing movement, and any combination thereof. Also, in the releasing movement, the movements of at least two driven bodies may be performed at the same time. The target releasing position is, for example, a position of the top of a mass (earth-and-sand mass) formed of the objects (earth and sand) released to the ground by the previous releasing movement. Specifically, the controller 30 determines, as an angle required for swiveling (required swiveling angle), an angle between a straight line (target line) perpendicular to the swiveling axis PV and passing through the target releasing position, and the center line of the attachment AT (front-back axis of the upper swiveling body 3). Then, the controller 30 informs the operator of the determined required swiveling angle through the display device 40, the indoor alarm 45B, and the like.

More specifically, the controller 30 obtains information from the boom angle sensor S1, the arm angle sensor S2, the bucket angle sensor S3, the machine body tilt sensor S4, the swivel angular velocity sensor S5, the operation sensor 29, the space recognition device 70, the positioning device 85, the switch SW, and the like. For example, the controller 30 calculates the required swiveling angle based on the obtained information, and informs the operator of the size of the calculated required swiveling angle through an image displayed on the display device 40, a sound output from the indoor alarm 45B, or the like. For example, the controller 30 may output, from the indoor alarm 45B, an intermittent sound that has shorter intervals as the required swiveling angle becomes smaller. In this case, the controller 30 may output a continuous sound from the indoor alarm 45B when the required swiveling angle becomes zero, i.e., when the target line and the center line of the attachment AT (front-back axis of the upper swiveling body 3) coincide with each other.

The coordinates of the target releasing position are, for example, derived based on an image photographed by a camera serving as the space recognition device 70. For deriving the coordinates of the target releasing position, the output from the positioning device 85 may be used. In the illustrated example, the coordinates of the target releasing position are expressed in a reference coordinate system. The reference coordinate system is, for example, the world geodetic system. The world geodetic system is a three-dimensional orthogonal XYZ coordinate system in which the origin is set at the center of gravity of the globe, the X axis is taken in a direction toward the intersection between the Greenwich meridian and the equator, the Y axis is taken in a direction at 90 degrees of the east longitude, and the Z axis is taken in a direction toward the North Pole. For example, the operator may define a given point of a construction site as a reference point, and set the target releasing position based on a relative positional relationship to the reference point. Thereby, the controller 30 notifies the operator of the required swiveling angle through the display device 40, the indoor alarm 45B, or the like, and can guide the swiveling operation of the shovel 100 through the operation device 26 by the operator. Note that, the reference coordinate system may be a coordinate system other than the world geodetic system. For example, the reference coordinate system may be a local coordinate system in which a given point in the working site is defined as the reference point (the origin). Alternatively, the controller 30 may set a coordinate system used for deriving the coordinates of the target releasing position to be determined at a current time, based on the coordinates of the previous releasing position.

Also, the controller 30 may be configured to perform the machine control function of assisting manual operations of the shovel 100 by the operator, or automatically or autonomously move the shovel 100.

Specifically, the controller 30 may be configured to control the swiveling movement of the upper swiveling body 3 so that the upper swiveling body 3 is oriented toward the target releasing position when the operator manually performs the swiveling operation by performing the releasing movement assisting function, which is one example of the machine control function. More specifically, even if the operator manually performs the swiveling operation, the controller 30 may forcibly stop the swiveling hydraulic motor 2A when the target releasing position is, in a top view, on the center line of the attachment AT (front-back axis of the upper swiveling body 3). That is, the controller 30 may automatically stop the swiveling movement of the upper swiveling body 3 when the upper swiveling body 3 is oriented toward the target releasing position. Note that, the controller 30 may gradually reduce the swiveling speed of the upper swiveling body 3 before stopping the swiveling movement of the upper swiveling body 3.

Alternatively, when the operator manually performs the swiveling operation, the controller 30 may automatically drive the swiveling hydraulic motor 2A, and the boom cylinder 7, the arm cylinder 8, the bucket cylinder 9, or any combination thereof so that the plane coordinates (X coordinate and Y coordinate) of the target releasing position coincides with the plane coordinates (X coordinate and Y coordinate) of the control target. The control target is, for example, a flat or curved plane forming a toe serving as a working portion of the bucket 6, a line segment defined on the flat or curved plane, or a point defined on the flat or curved plane. Also, the control target may be, for example, a flat or curved plane forming a back surface serving as a working portion of the bucket 6, a line segment defined on the flat or curved plane, or a point defined on the flat or curved plane. Note that, the control target may be set at the center point (centroid) of the bucket 6, or may be set at an arm top pin (bucket coupling pin). Also, in the illustrated example, the controller 30 moves various hydraulic actuators so as not to change in height of the control target (Z coordinate) during swiveling of the upper swiveling body 3, but may move various hydraulic actuators so that the control target reaches a position at a predetermined height directly above the target releasing position. That is, during swiveling of the upper swiveling body 3, the controller 30 may change the height (Z coordinate) of the control target in addition to the plane coordinates (X coordinate and Y coordinate) of the control target. In this case, the target releasing position may be set as a position higher by a predetermined height than the position of the top of the mass (earth-and-sand mass) formed of the objects (earth and sand) released to the ground by the previous releasing movement. Also, the target releasing position may be a position other than the top of the mass (earth-and-sand mass) formed by the last releasing movement. This is because the earth and sand released from the bucket 6 are not necessarily evenly accumulated. For example, when a large amount of the earth and sand tend to accumulate by the releasing movement in a region farther from the shovel 100 than the target releasing position, the controller 30 may set the target releasing position at a position closer to the shovel 100 by a predetermined distance from the top of the already formed mass (earth-and-sand mass). Conversely, for example, when a large amount of the earth and sand tend to accumulate in a region closer to the shovel 100 than the target releasing position, the controller 30 may set the target releasing position at a position away from the shovel 100 by a predetermined distance from the top of the already formed mass (earth-and-sand mass). Also, when there are a plurality of masses (earth-and-sand masses) formed by the past releasing movements, the controller 30 may set the target releasing position at a predetermined position in a valley portion (recessed portion) formed between one earth-and-sand mass and another earth-and-sand mass. In this way, the coordinates of the control target are three-dimensionally set in a space above the ground.

More specifically, when the operator operates the left operation lever 26L for swiveling the upper swiveling body 3 while operating (pressing) the switch SW, the controller 30 automatically drives, in accordance with the operation of the left operation lever 26L by the operator, the swiveling hydraulic motor 2A, and the boom cylinder 7, the arm cylinder 8, the bucket cylinder 9, or any combination thereof so that the plane coordinates (X coordinate and Y coordinate) of the target releasing position coincides with the plane coordinates (X coordinate and Y coordinate) of the control target. More specifically, as described above, the controller 30 controls the electromagnetic valve 31, and automatically drives the swiveling hydraulic motor 2A, and the boom cylinder 7, the arm cylinder 8, the bucket cylinder 9, or any combination thereof. Thereby, only by operating the left operation lever 26L in the leftward and rightward directions, the operator can position the bucket 6, in which the earth and sand are taken, directly above the target releasing position. Only by manually performing the bucket opening operation after positioning the bucket 6 directly above the target releasing position, the operator can release the earth and sand in the bucket 6 toward the target releasing position.

Note that, when the operator operates the left operation lever 26L in the leftward and rightward directions while pressing the switch SW, the controller 30 may position the bucket 6, in which the earth and sand are taken, directly above the target releasing position, and then automatically release the earth and sand in the bucket 6 toward the ground. That is, the controller 30 may position the bucket 6, in which the earth and sand are taken, directly above the target releasing position, and then automatically retract the bucket cylinder 9 and open the bucket 6. In this case, the controller 30 may automatically perform a movement other than the bucket opening movement, such as the boom raising movement, the boom lowering movement, the arm closing movement, the arm opening movement, or the like. Thereby, only by operating the left operation lever 26L in the leftward and rightward directions, the operator can position the bucket 6, in which the earth and sand are taken, directly above the target releasing position, and then release the earth and sand in the bucket 6 toward the target releasing position.

Moreover, calculation of the target releasing position may be performed utilizing the trained model that is mainly constructed of a neural network or a deep neural network. In other words, the controller 30 may set the target releasing position by utilizing the trained model.

For example, machine learning based on the neural network or the deep neural network, specifically deep learning, is performed for optimization of weighting parameters.

Thereby, for example, the neural network or the deep neural network can receive an input signal x and output an output signal y. The input signal x is an input of image data obtained by the space recognition device 70, or a status of the current working site that is a three-dimensional map of the working site generated based on the image data. The output signal y is an output of the target releasing position that is a preferable releasing position suitable for the status of the current working site (e.g., the feature of the ground (irregularities) or the presence or absence of an obstacle).

Specifically, the controller 30 may be configured to learn conditions associated with the preferable releasing position. For example, the controller 30 may be configured to learn a relationship between the status of the working site (e.g., the feature of the ground (irregularities) or the presence or absence of the obstacle) and the preferable releasing position (conditions for the preferable releasing position) in accordance with a dataset. The dataset is created based on combination of information in relation to, for example, the status of the current working site obtained by the space recognition device 70 and reference information representing "conditions for the preferable releasing position" serving as determination data previously stored in a non-volatile storage device. This learning process may be performed in a managing device (machine learning device) connected to the shovel 100 via a wireless communication. In this case, using the trained model created in the managing device (machine learning device), the managing device (machine learning device) can determine the preferable releasing position suitable for the status of the working site where the shovel 100 to be managed is present, and thereby can calculate the target releasing position. The controller 30 receives the target releasing position calculated in the managing device (machine learning device) and performs the soil releasing movement of the shovel 100 based on the received target releasing position. Also, the calculated target releasing position may be transmitted from the managing device (machine learning device) to the shovel 100 or an assisting device. In this case, by displaying the target releasing position on the display device in the shovel 100 or the assisting device, the operator or worker can confirm the target releasing position calculated by the managing device (machine learning device).

Figure 5:
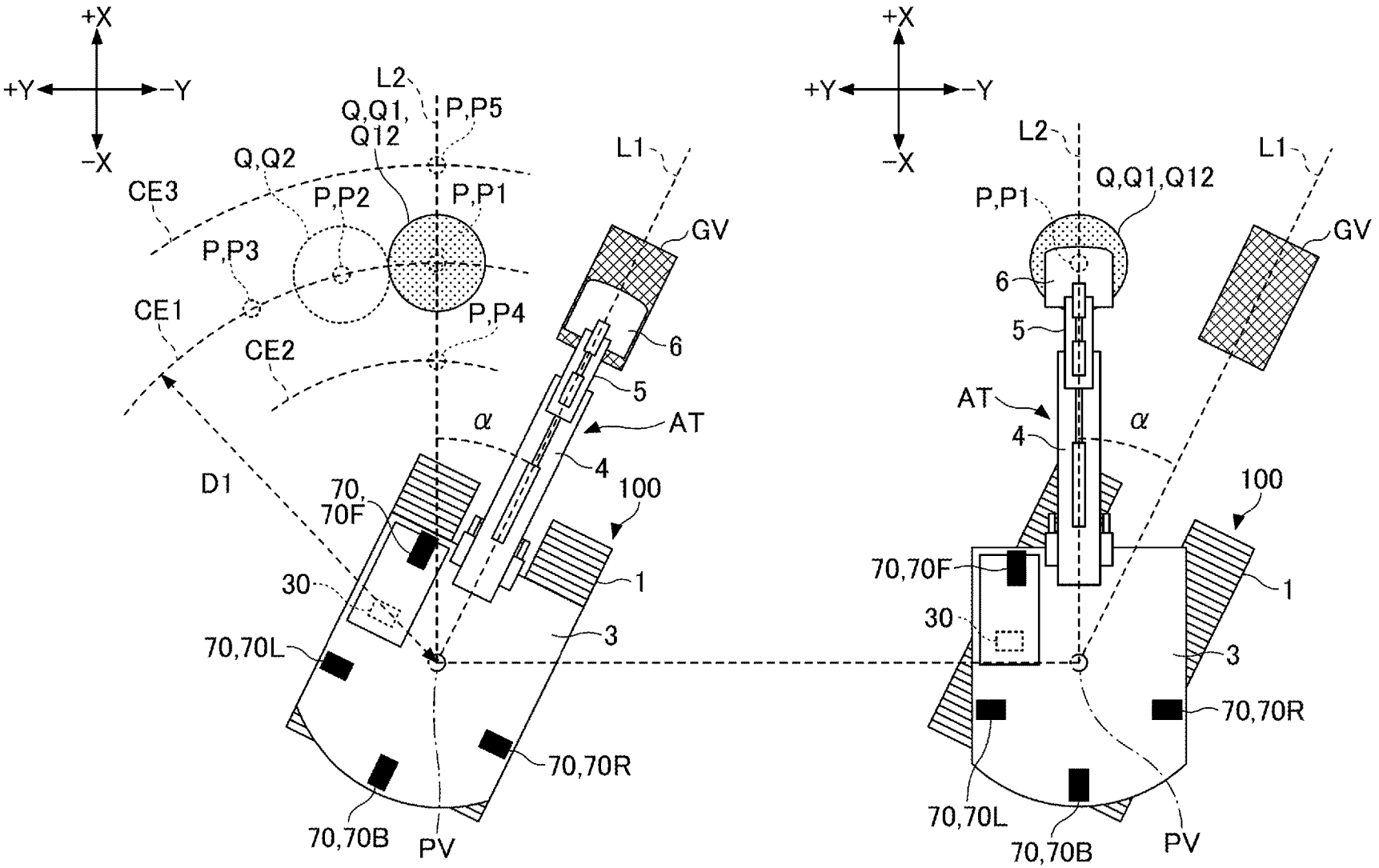
FIG. 5 is a top view of the shovel in which a releasing movement assisting function is performed.
Figure 6:
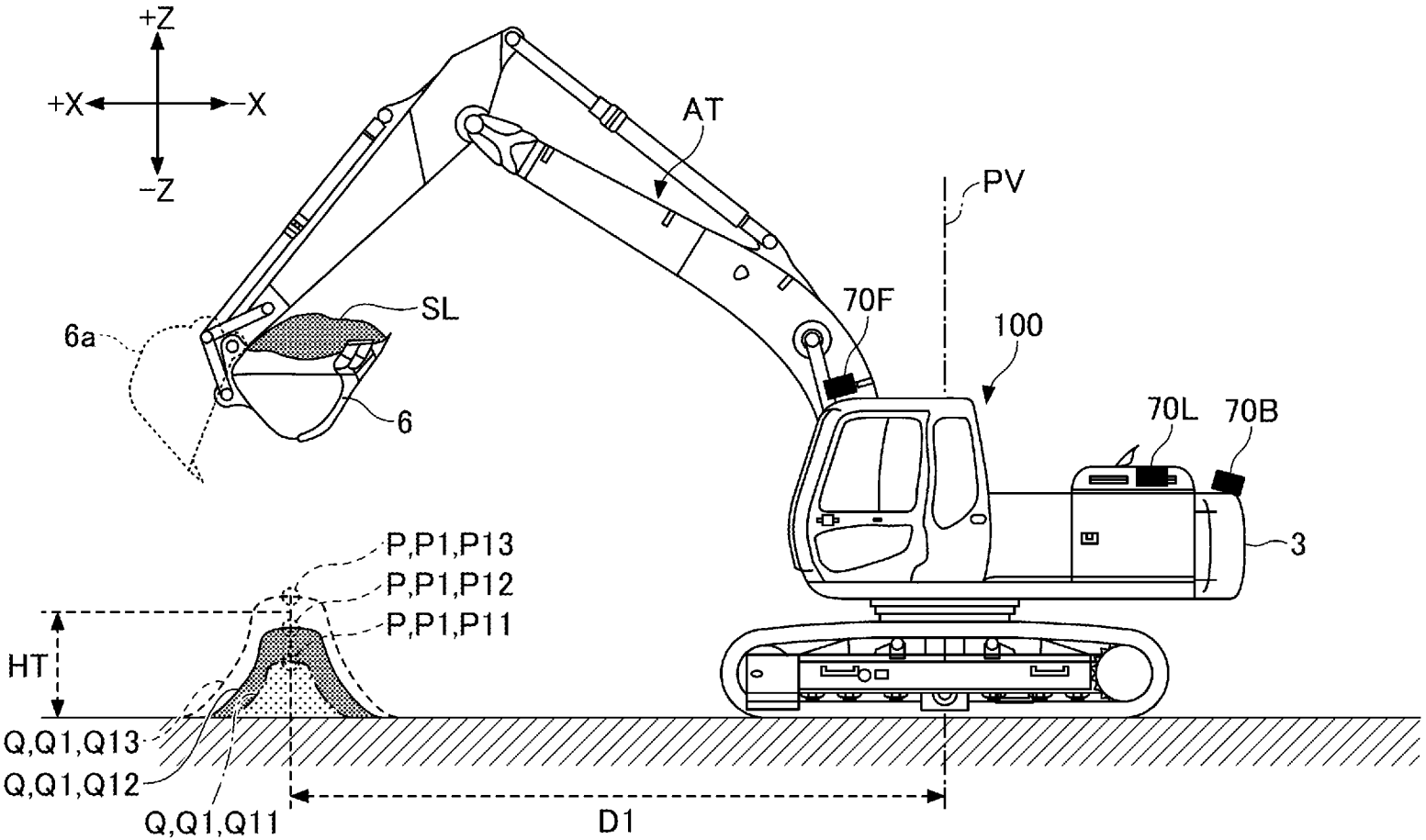
FIG. 6 is a left lateral view of the shovel in which the releasing movement assisting function is performed.

Next, the movement of the shovel 100 in which the releasing movement assisting function is performed will be described with reference to FIG. 5 and FIG. 6. FIG. 5 is a top view of the shovel 100 in which the releasing movement assisting function is performed, and FIG. 6 is a left lateral view of the shovel 100 in which the releasing movement assisting function is performed. Specifically, the left-hand part of FIG. 5 is a top view of the shovel 100 that performs the third excavating movement, and the right-hand part of FIG. 5 is a top view of the shovel 100 that performs the third releasing movement. Also, FIG. 6 is a left lateral view of the shovel 100 that performs the third releasing movement. In the illustrated example, the releasing movement is a series of movements including the swiveling movement and the bucket opening movement, and is performed after the excavating movement. That is, the first releasing movement is performed after the first excavating movement, the second releasing movement is performed after the second excavating movement, and the third releasing movement is preformed after the third excavating movement. The same applies to the fourth and subsequent releasing movements. Also, in the illustrated example, the excavating movement is a series of movements for excavating a groove GV along a direction indicated by a dashed line L1, and includes at least the arm closing movement, the bucket closing movement, and the boom raising movement. During the excavating movement, the dashed line L1 corresponds to the center line of the attachment AT (front-back axis of the upper swiveling body 3).

An earth-and-sand mass Q illustrated in the left-hand part of FIG. 5 is the earth-and-sand mass formed of the earth and sand released toward the ground from the bucket 6 by the releasing movement. The earth-and-sand mass Q includes a first earth-and-sand mass Q1, which is formed for the first time, and a second earth-and-sand mass Q2, which is formed the next time. In the example illustrated in the left-hand part of FIG. 5, the first earth-and-sand mass Q1 is an earth-and-sand mass that is already partially formed, and the first earth-and-sand mass Q1 is denoted by a solid line. The second earth-and-sand mass Q2 is an earth-and-sand mass to be formed, i.e., an earth-and-sand mass that is not present at this time, and the second earth-and-sand mass Q2 is denoted by a dashed line.

In the illustrated example, the respective earth-and-sand masses Q are formed so as not to excessively exceed a limit height HT (see FIG. 6). The limit height HT is an allowable maximum height of the earth-and-sand mass formed of the earth and sand released to the ground by the releasing movement. In the illustrated example, the limit height HT is previously stored in an internal memory. The controller 30 controls the shovel 100 so that when the height of the first earth-and-sand mass Q1 exceeds the limit height HT, formation of the first earth-and-sand mass Q1 is stopped and formation of the second earth-and-sand mass Q2 is started. The same applies to an unillustrated third earth-and-sand mass, which will be formed later, and the subsequent earth-and-sand masses.

As illustrated in FIG. 6, the first earth-and-sand mass Q1 includes a first portion Q11 formed of the earth and sand released by the first releasing movement, a second portion Q12 formed of the earth and sand released by the second releasing movement, and a third portion Q13 formed of the earth and sand to be released by the third releasing movement. In FIG. 6, for clarification, the first portion Q11 demarcated by a chain line is given a rough dot pattern, and the second portion Q12 demarcated by a solid line is given a fine dot pattern. Also, the third portion Q13, which has not been formed yet, is represented by a dashed line. As illustrated in FIG. 6, when earth and sand SL taken in the bucket 6 are released toward the ground, the third portion Q13 is formed on the second portion Q12, and the height of the first earth-and-sand mass Q1 exceeds the limit height HT. Note that, a bucket 6*a* of FIG. 6 illustrates the bucket 6 that is opened for releasing the earth and sand SL toward the ground.

In the illustrated example, the first releasing movement is performed in response to a manual operation of the operation device 26 by the operator of the shovel 100. Meanwhile, the second and subsequent releasing movements are semi-automatically performed through the releasing movement assisting function. Specifically, the second and subsequent releasing movements are semi-automatically performed in response to the manual operation of the swiveling operation lever by the operator of the shovel 100 while pressing the switch SW. That is, movements other than the swiveling movement are automatically performed regardless of the presence or absence of the manual operation of the corresponding operation lever. Specifically, the arm opening movement is automatically performed even if the manual operation of the arm operation lever is not performed. More specifically, the controller 30 moves various hydraulic actuators so as not to change the height of the control target (Z coordinate) before the start of the manual operation of the swiveling operation lever, and causes the plane coordinates (X coordinate and Y coordinate) of the control target to coincide with the plane coordinates (X coordinate and Y coordinate) of the target releasing position. However, the controller 30 may move various hydraulic actuators so that the position of the control target is a position that is higher than the target releasing position by a predetermined height. That is, the controller 30 may move the control target to a height different from the height of the control target (Z coordinate) before the start of the manual operation of the swiveling operation lever. In this way, the controller 30 can automatically move the bucket 6, in which the earth and sand are taken by the excavating movement, to a position directly above the target releasing position through the releasing movement assisting function. Here, the controller 30 may perform the boom raising movement, an arm opening and closing movement, or both so that the position of the toe of the bucket 6 is maintained at the position of the toe upon the start of the soil releasing movement during a period of from the start of the soil releasing movement until completion of the soil releasing movement. This is for accumulating the earth and sand released by the second and subsequent releasing movements, on the earth-and-sand mass formed by the first releasing movement.

In the illustrated example, the controller 30 derives a position P11 of the top of the first portion Q11 of the first earth-and-sand mass Q1 formed of the earth and sand released by the first releasing movement. This derivation is performed based on an image showing a forward space of the upper swiveling body 3 photographed by the forward camera 70F during a period of from the completion of the first releasing movement until completion of the second excavating movement. Then, the controller 30 sets the position P11 of that top as a target releasing position P (first target releasing position P1).

Subsequently, as illustrated in the left-hand part of FIG. 5, the controller 30 derives a required swiveling angle α based on: the center line of the attachment AT at this time (front-back axis of the upper swiveling body 3) (dashed line L1); and a target line L2 that is a straight line passing through the target releasing position P (first target releasing position P1) and the swiveling axis PV (center point of swiveling).

The required swiveling angle α is an angle formed between: the target line L2 that is a straight line passing through the target releasing position P and the swiveling axis PV; and the dashed line L1 corresponding to the center line of the attachment AT (front-back axis of the upper swiveling body 3).

Subsequently, the controller 30 swivels the upper swiveling body 3 leftward by the required swiveling angle α in response to the swiveling operation lever being operated in the leftward swiveling direction with the switch SW being pressed. When the swiveling angle of the upper swiveling body 3 reaches the required swiveling angle α, the controller 30 stops a leftward swiveling movement of the upper swiveling body 3 even if the operation of the swiveling operation lever in the leftward swiveling direction continues. Note that, when the operation of the swiveling operation lever in the leftward swiveling direction is stopped before the swiveling angle of the upper swiveling body 3 reaches the required swiveling angle α, the controller 30 stops the leftward swiveling movement of the upper swiveling body 3. This is for giving priority to the manual operation of the swiveling operation lever by the operator. Also, the controller 30 may reduce the swiveling speed as the swiveling angle of the upper swiveling body 3 becomes closer to the required swiveling angle α. This is for preventing the leftward swiveling movement of the upper swiveling body 3 from suddenly stopping at the time the swiveling angle of the upper swiveling body 3 reaches the required swiveling angle α. Also, in the illustrated example, the controller 30 determines the swiveling speed of the upper swiveling body 3 in accordance with the amount of the operation of the swiveling operation lever by the operator. That is, the controller 30 controls the swiveling movement of the upper swiveling body 3 so that the swiveling speed becomes higher as the amount of the operation of the swiveling operation lever becomes larger. However, the controller 30 may be configured to determine the swiveling speed of the upper swiveling body 3 regardless of the amount of the operation of the swiveling operation lever. This is for preventing the swiveling speed of the upper swiveling body 3 from becoming excessively higher.

Subsequently, the operator releases the earth and sand in the bucket 6 toward the target releasing position by manually operating the bucket operation lever in the bucket opening direction, with the plane coordinates of the target releasing position (X coordinate and Y coordinate) coinciding with the plane coordinates (X coordinate and Y coordinate) of the control target. Note that, the movement of releasing the earth and sand in the bucket 6 toward the target releasing position may be automatically performed.

The same applies to the third releasing movement. Specifically, the controller 30 derives a position P12 of the top of the second portion Q12 of the first earth-and-sand mass Q1 formed of the earth and sand released by the second releasing movement. This derivation is performed based on an image showing a forward space of the upper swiveling body 3 photographed by the forward camera 70F during a period of from the completion of the second releasing movement until completion of the third excavating movement. Then, the controller 30 sets the position P12 of that top as the target releasing position P (first target releasing position P1). Note that, the controller 30 may set the position P11 of the top of the first portion Q11 of the first earth-and-sand mass Q1, as the target releasing position P. Also, the controller 30 may set the target releasing position P in the second and subsequent releasing movements at a position away from the top of the earth-and-sand mass by a predetermined distance in accordance with the extent of accumulation of the earth and sand.

In the illustrated example, meanwhile, in the fourth releasing movement, the controller 30 sets the target releasing position P at a position other than the position of the first earth-and-sand mass Q1. This is for preventing the height of the first earth-and-sand mass Q1 from excessively exceeding the limit height HT.

Specifically, the controller 30 sets the target releasing position P at a position other than the position of the first earth-and-sand mass Q1 when recognizing that the height of the top of the first earth-and-sand mass Q1 is higher than the limit height HT. This setting is performed based on an image showing a forward space of the upper swiveling body 3 photographed by the forward camera 70F during a period of from the completion of the third releasing movement until completion of the fourth excavating movement. The controller 30 may update the three-dimensional map every time the earth-and-sand mass is formed by the soil releasing movement. Furthermore, when the height of the top of the earth-and-sand mass is higher than the limit height HT, the controller 30 may move the attachment so that the earth-and-sand mass is pressed from above by the back surface of the bucket 6. In this case, when recognizing that the top of the earth-and-sand mass has a flat shape and further the flat top of the earth-and-sand mass is higher than the limit height HT, the controller 30 may set the target releasing position P at a position other than the position of the top of the earth-and-sand mass.

In the example as illustrated in the left-hand part of FIG. 5, the controller 30 sets, as the target releasing position P (second target releasing position P2), another position away from the position of the top of the first earth-and-sand mass Q1 (first target releasing position P1) by a predetermined distance or more, with the second target releasing position P2 being on the circumference of a circle CE1 having a radius of a distance D1 between the position of the top of the first earth-and-sand mass Q1 (first target releasing position P1) and the swiveling axis PV. Subsequently, the second earth-and-sand mass Q2 is formed at the second target releasing position P2. When the height of the top of the second earth-and-sand mass Q2 exceeds the limit height HT, the controller 30 sets, as the target releasing position P (third target releasing position P3), still another position away from the position of the top of the second earth-and-sand mass Q2 (second target releasing position P2) by a predetermined distance or more, with the third target releasing position P3 being on the circumference of the circle CE1. The same applies to the fourth and subsequent earth-and-sand masses. At this time, the controller 30 may control the movement of the attachment until the bucket 6 reaches a position directly above the target releasing position P so that the bucket 6 does not contact the already formed earth-and-sand mass.

Alternatively, the controller 30 may set, as the target releasing position P, another position on the target line L2 away from the position of the top of the first earth-and-sand mass Q1 (first target releasing position P1) by a predetermined distance or more (e.g., the fourth target releasing position P4 at a position closer to the swiveling axis PV than the first target releasing position P1). In this case, when the height of the top of the earth-and-sand mass Q formed at the fourth target releasing position P4 exceeds the limit height HT, the controller 30 may set, as the target releasing position P, still another position away from the fourth target releasing position P4 by a predetermined distance or more, with the target releasing position P being on the circumference of a circle CE2 having a radius of a distance between the fourth target releasing position P4 and the swiveling axis PV.

Alternatively, the controller 30 may set, as the target releasing position P, another position on the target line L2 away from the position of the top of the first earth-and-sand mass Q1 (first target releasing position P1) by a predetermined distance or more (e.g., the fifth target releasing position P5 at a position farther from the swiveling axis PV than the first target releasing position P1). In this case, when the height of the top of the earth-and-sand mass Q formed at the fifth target releasing position P5 exceeds the limit height HT, the controller 30 may set, as the target releasing position P, still another position away from the fifth target releasing position P5 by a predetermined distance or more, with the target releasing position P being on the circumference of a circle CE3 having a radius of a distance between the fifth target releasing position P5 and the swiveling axis PV. Here, the target releasing position is set within a soil releasable region that is previously set in the working site. When the accumulated earth and sand spread outward of the soil releasable region, the controller 30 may set the target releasing position P at a predetermined position in the valley portion (recessed portion) formed between one earth-and-sand mass and another earth-and-sand mass. Also, when the accumulated earth and sand spread outward of the soil releasable region, the controller 30 may elevate the limit height HT. In this way, the controller 30 may set the target releasing position P based on: the feature of the earth-and-sand mass formed by the soil releasing movement; and the limit height HT.

Alternatively, after completion of the fourth excavating movement, the operator of the shovel 100 may manually set the second target releasing position P2 that is a position at which the second earth-and-sand mass Q2 is to be formed. Specifically, after moving the bucket 6 to a position directly above the position at which the second earth-and-sand mass Q2 is to be formed, by manually operating the operation device 26 without pressing the switch SW, the operator may manually operate the bucket operation lever and perform the bucket opening movement, and release the earth and sand toward that position. After completion of this fourth manual releasing movement, the controller 30 may set, as the target releasing position P for the fifth and subsequent releasing movements, a position of the top of the second earth-and-sand mass Q2 formed of the earth and sand released to the ground by the fourth releasing movement. This setting is performed based on an image showing a forward space of the upper swiveling body 3 photographed by the forward camera 70F during a period until completion of the fifth excavating movement.

Also, the controller 30 may be configured to automatically move the bucket 6, in which the earth and sand are taken by the excavating movement, to a position directly above the target releasing position P through the releasing movement assisting function. Specifically, in response to the manual operation of the swiveling operation lever by the operator of the shovel 100 while pressing the switch SW, the controller 30 may automatically perform movements other than the swiveling movement regardless of the presence or absence of the manual operation of the corresponding operation lever. In this case, for example, the arm opening movement may be automatically performed even if no manual operation of the arm operation lever is performed.

More specifically, at the time the second excavating movement (boom raising movement) is completed, the controller 30 generates a track (target track) from the current position of the bucket 6 to the position directly above the target releasing position P (soil releasing movement starting position). The position directly above the target releasing position P is a position that is vertically directly above the target releasing position P by a predetermined distance (e.g., 10 cm). The soil releasing movement starting position to be a terminal point of the track is three-dimensionally set. At this time, the target track is generated so that the bucket 6 does not contact the already formed earth-and-sand mass. In this way, the controller 30 may calculate the soil releasing movement starting position based on the status of the working site (the feature (irregularities) of the earth-and-sand mass formed by the soil releasing movement). Moreover, the controller 30 may calculate the soil releasing movement starting position based on, for example, the presence or absence of an obstacle as the status of the working site.

Subsequently, when the swiveling operation lever is operated in the leftward swiveling direction with the switch SW being pressed, the controller 30 automatically moves the bucket 6 to a position directly above the target releasing position P by moving the attachment while swiveling the upper swiveling body 3 leftward by the required swiveling angle $\alpha$. Specifically, the controller 30 drives the swiveling hydraulic motor 2A, and the boom cylinder 7, the arm cylinder 8, the bucket cylinder 9, or any combination thereof, thereby moving the bucket 6 along the target track.

Also, the controller 30 may be configured to automatically open the bucket 6, which is automatically moved to the position directly above the target releasing position P, through the releasing movement assisting function. Specifically, in response to the manual operation of the swiveling operation lever by the operator of the shovel 100 while pressing the switch SW, the controller 30 may automatically perform the bucket opening movement regardless of the presence or absence of the manual operation of the bucket operation lever.

Subsequently, when the swiveling operation lever is operated in the opposite direction (rightward swiveling direction) with the switch SW being pressed, the controller 30 may be configured to swivel the upper swiveling body 3 rightward until the center line of the attachment AT (front-back axis of the upper swiveling body 3) coincides with the dashed line L1 indicating the extending direction of the groove GV. This is for returning the bucket 6 directly above the excavating position (groove GV).

Figure 7A:
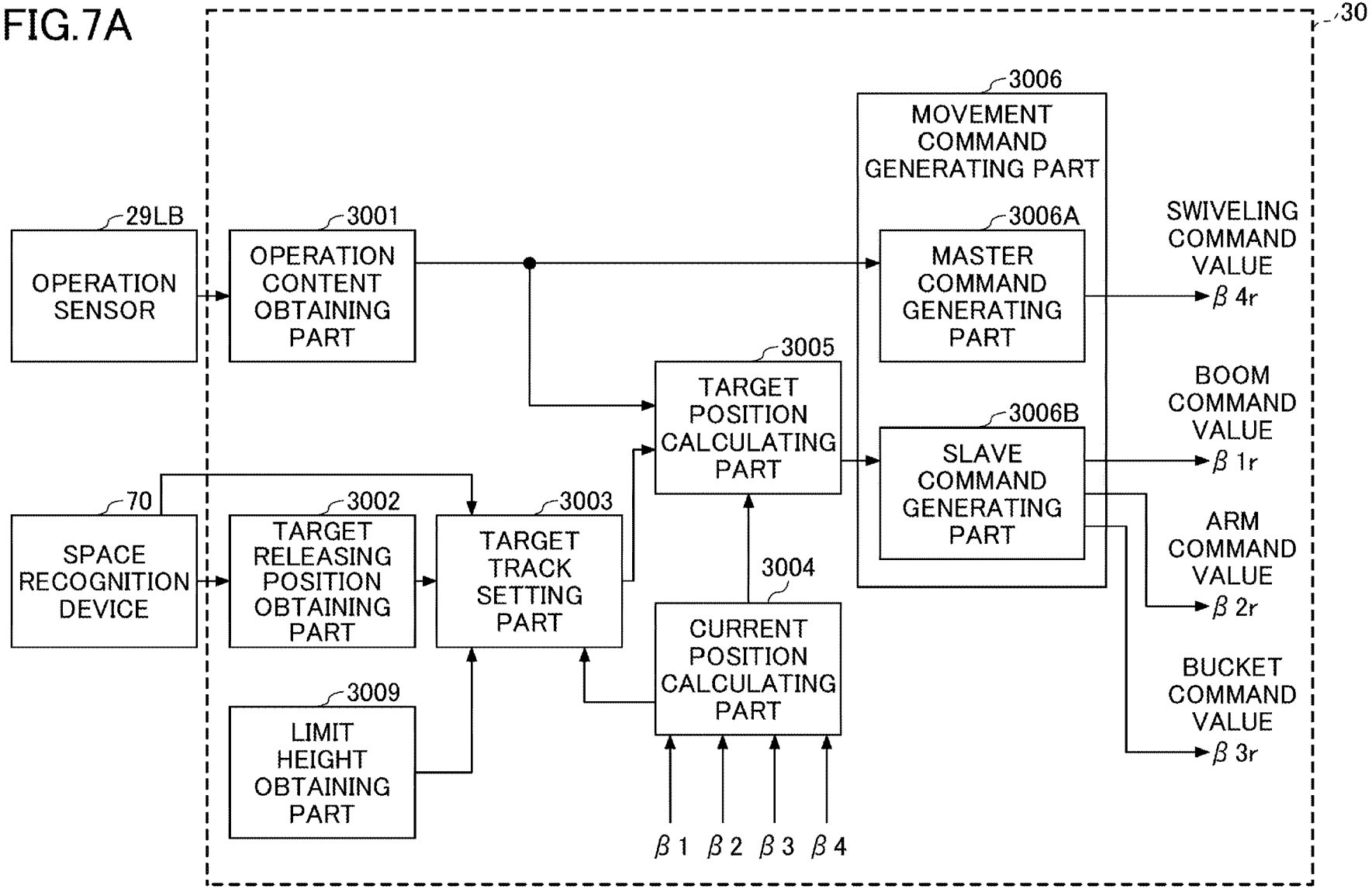
FIG. 7A is a view illustrating a configuration example of a controller.
Figure 7B:
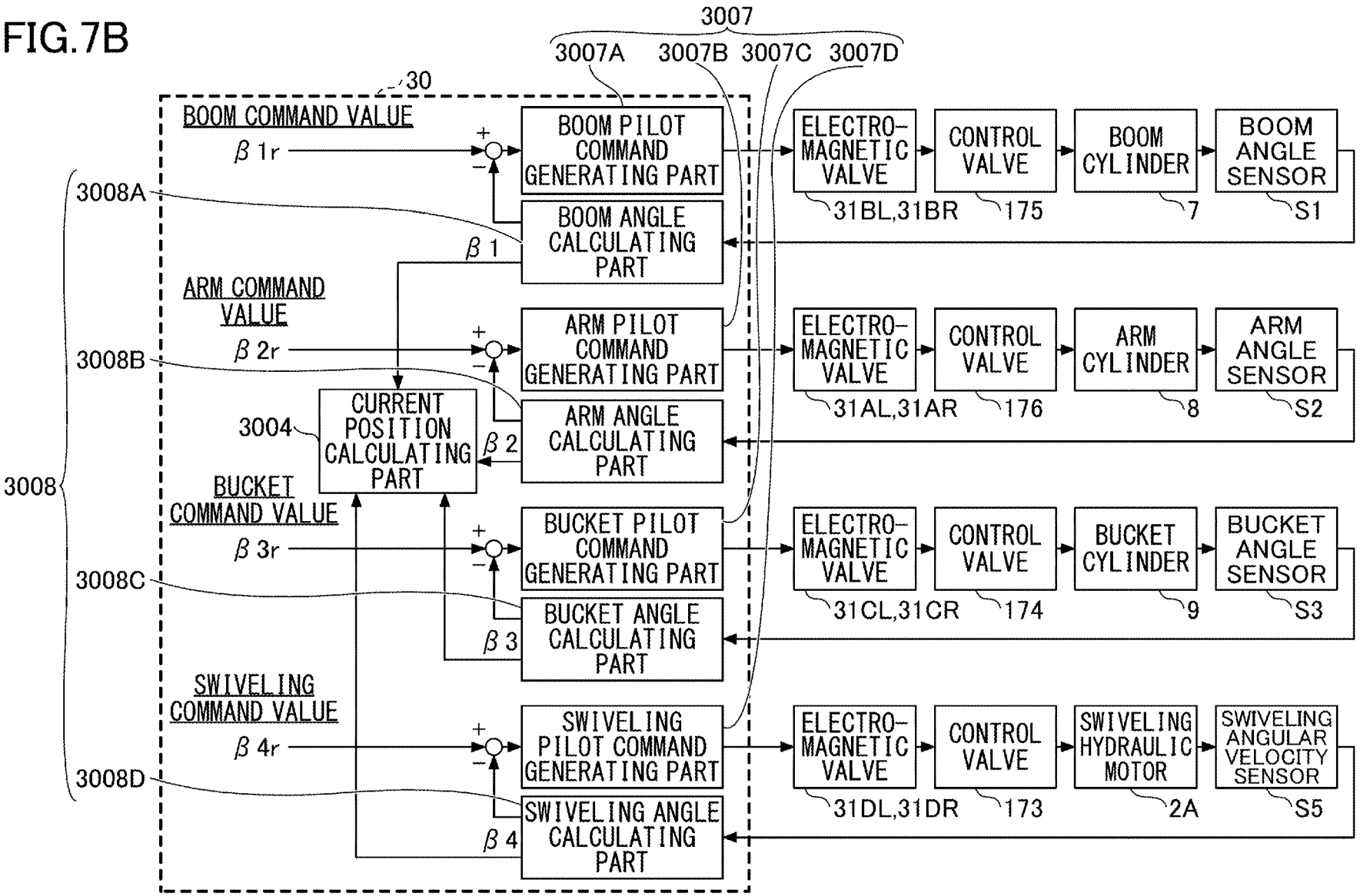
FIG. 7B is a view illustrating a configuration example of the controller.

Next, one example of the configuration in relation to the machine control function will be described with reference to FIG. 7A and FIG. 7B. FIG. 7A and FIG. 7B are each a view illustrating a configuration example of the controller 30. Specifically, FIG. 7A and FIG. 7B each illustrate a detailed configuration in relation to the machine control function. Note that, the following description made with reference to FIG. 7A and FIG. 7B is related to the machine control function that is performed when the left operation lever 26L (swiveling operation lever) for moving the upper swiveling body 3 is operated with the switch SW being operated. Specifically, the following description is related to the machine control function of automatically driving the swiveling hydraulic motor 2A, and the boom cylinder 7, the arm cylinder 8, the bucket cylinder 9, or any combination thereof so that the plane coordinates (X coordinate and Y coordinate) of the target releasing position coincides with the plane coordinates (X coordinate and Y coordinate) of the control target when the operator manually performs the swiveling operation.

The controller 30 includes an operation content obtaining part 3001, a target releasing position obtaining part 3002, a target track setting part 3003, a current position calculating part 3004, a target position calculating part 3005, a movement command generating part 3006, a pilot command generating part 3007, a posture angle calculating part 3008, and a limit height obtaining part 3009, as functional parts in relation to the machine control function. In the illustrated example, the nine functional parts are each realized by software. However, the nine functional parts may be each realized by hardware (e.g., an electronic circuit) or may be realized by a combination of software and hardware. Also, in the illustrated example, when the switch SW is operated, the nine functional parts repeatedly perform the below-described process for each of the predetermined control cycles.

The operation content obtaining part 3001 obtains the content of the operation of the swiveling operation lever based on a detection signal taken from the operation sensor 29LB. For example, the operation content obtaining part 3001 obtains (calculates), as the content of the operation, the direction of the operation (whether the operation is the leftward swiveling operation or the rightward swiveling operation) and the amount of the operation.

The target releasing position obtaining part 3002 obtains, for example, data in relation to the target releasing position based on the output from the space recognition device 70. In the illustrated example, the target releasing position obtaining part 3002 obtains, as the target releasing position, the position of the top of the earth-and-sand mass formed of the earth and sand released to the ground by the last releasing movement. This obtainment is performed based on an image photographed by the backward camera 70B, the forward camera 70F, the leftward camera 70L, the rightward camera 70R, or any combination thereof, serving as the space recognition device 70. The data in relation to the target releasing position is, for example, two- or three-dimensional coordinates of the target releasing position.

In the illustrated example, the first releasing movement is performed in response to the manual operation of the operation device 26 by the operator of the shovel 100. The second releasing movement is performed in response to the manual operation of the swiveling operation lever by the operator of the shovel 100 through the machine control function after the target releasing position is set as the position of the top of the earth-and-sand mass formed of the earth and sand released to the ground by the first releasing movement. The third and subsequent releasing movements are performed in response to the manual operation of the swiveling operation lever by the operator of the shovel 100 through the machine control function after the target releasing position is set as the position of the top of the earth-and-sand mass formed of the earth and sand released to the ground by the first or second releasing movement. In the second and subsequent releasing movements, the bucket opening movement for releasing the earth and sand in the bucket 6 may be performed in response to the manual operation of the bucket operation lever by the operator, or may be performed regardless of the presence or absence of the manual operation of the bucket operation lever by the operator, i.e., may be automatically performed in response to the manual operation of the swiveling operation lever by the operator.

The target track setting part 3003 sets, based on the data in relation to the target releasing position, information in relation to the target track for moving the control target to the position directly above the target releasing position (soil releasing movement starting position). The position directly above the target releasing position is, for example, a position that is vertically directly above the target releasing position P by a predetermined distance (e.g., 10 cm). In the illustrated example, the target track setting part 3003 sets the target track based on: the coordinates of the current position of the control target; and the coordinates of the target releasing position. Also, the target track setting part 3003 may utilize information in relation to the feature of the ground around the shovel 100. In this case, the target track setting part 3003 may obtain information in relation to the feature of the ground around the shovel 100 based on the output from the space recognition device 70.

The current position calculating part 3004 calculates the position (current position) of the control target. Specifically, the position of the control target may be based on a boom angle β1, an arm angle β2, a bucket angle β3, and a swiveling angle β4 that are calculated by the posture angle calculating part 3008.

The target position calculating part 3005 calculates the target position of the control target based on: the content of the operation of the swiveling operation lever (direction and amount of the operation); information in relation to the set target track; and the current position of the control target.

This target position is a position on the target track that is to be reached during the control cycle performed at a current time, assuming that the upper swiveling body 3 is swiveled in accordance with the direction and the amount of the operation of the swiveling operation lever. The target position calculating part 3005 may calculate the target position of the control target using, for example, a map or a calculation formula previously stored in the internal memory or the like.

The movement command generating part 3006 generates, based on the target position of the control target, a command value in relation to the movement of the boom 4 (hereinafter referred to as a "boom command value β1r"), a command value in relation to the movement of the arm 5 (hereinafter referred to as an "arm command value β2r"), a command value in relation to the movement of the bucket 6 (hereinafter referred to as a "bucket command value β3r"), and a command value in relation to the movement of the upper swiveling body 3 (hereinafter referred to as a "swiveling command value β4r"). In the illustrated example, the boom command value β1r, the arm command value β2r, the bucket command value β3r, and the swiveling command value β4r are respectively a boom angle, an arm angle, a bucket angle, and a swiveling angle when the control target has achieved the target position. Note that, the boom command value β1r, the arm command value β2r, the bucket command value β3r, and the swiveling command value β4r are rotation speeds (swiveling speeds) or rotation accelerations (swiveling accelerations) of the boom 4, the arm 5, the bucket 6, and the upper swiveling body 3 necessary for the control target to reach the target position.

The movement command generating part 3006 may include a master command generating part 3006A and a slave command generating part 3006B. The master command generating part 3006A generates a command value in relation to the movement of a working element (hereinafter referred to as a "master element") that moves in accordance with the content of the operation of the operation device 26 (hereinafter this command value is referred to as a "master command value"). Note that, an operation lever configured to operate the master element is also referred to as a "master operation lever". In the illustrated example, the master element is the upper swiveling body 3, the master operation lever is the swiveling operation lever, and the master command generating part 3006A generates the swiveling command value β4r and outputs the swiveling command value β4r to a swiveling pilot command generating part 3007D. Specifically, the master command generating part 3006A generates the swiveling command value β4r in accordance with the content of the operation of the swiveling operation lever (direction and amount of the operation). The master command generating part 3006A may generate and output the swiveling command value β4r based on: the content of the operation of the swiveling operation lever; a predetermined map or conversion formula defining a relationship with the swiveling command value β4r; or the like.

The slave command generating part 3006B generates a command value in relation to the movement of, among working elements, a working element (hereinafter referred to as a "slave element") that moves in accordance with (in synchronization with) the movement (swiveling) of the master element (upper swiveling body 3) so that the control target moves along the target track (hereinafter this command value is referred to as a "slave command value"). In the illustrated example, the slave element is the boom 4, the arm 5, and the bucket 6. The slave command generating part 3006B generates the boom command value β1r, the arm command value β2r, and the bucket command value β3r, and outputs the boom command value β1r, the arm command value β2r, and the bucket command value β3r to a boom pilot command generating part 3007A, an arm pilot command generating part 3007B, and a bucket pilot command generating part 3007C, respectively. Specifically, the slave command generating part 3006B generates the boom command value β1r, the arm command value β2r, and the bucket command value β3r so that the boom 4, the arm 5, the bucket 6, or any combination thereof move in accordance with (in synchronization with) the movement (swiveling) of the upper swiveling body 3 corresponding to the swiveling command value β4r, and the control target can reach the target position (i.e., move along the target track). Thereby, the controller 30 can move the control target along the target track by moving the attachment AT in accordance with (i.e., in synchronization with) the movement (swiveling) of the upper swiveling body 3 corresponding to the content of the operation of the swiveling operation lever. That is, the upper swiveling body 3 (swiveling hydraulic motor 2A) moves in accordance with an input of the operation of the swiveling operation lever, and the movements of the boom 4 (boom cylinder 7), the arm 5 (arm cylinder 8), and the bucket 6 (bucket cylinder 9) are controlled in accordance with the movement of the upper swiveling body 3 (swiveling hydraulic motor 2A) so that the control target, such as the center point of the bucket 6 or the like, moves along the target track.

In order to achieve the angles (boom angle, arm angle, bucket angle, and swiveling angle β4) corresponding to the command values (boom command value β1r, arm command value β2r, bucket command value β3r, and swiveling command value β4r), the pilot command generating part 3007 is configured to generate a command value of the pilot pressure (hereinafter referred to as a "pilot pressure command value") to be applied to the control valve (control valves 173 to 176). Specifically, the pilot command generating part 3007 includes the boom pilot command generating part 3007A, the arm pilot command generating part 3007B, the bucket pilot command generating part 3007C, and the swiveling pilot command generating part 3007D.

The boom pilot command generating part 3007A generates the pilot pressure command value to be applied to the control valve 175 corresponding to the boom cylinder 7 driving the boom 4 based on a difference between the boom command value β1r and a calculation value (measurement value) of the current boom angle calculated by a boom angle calculating part 3008A. The boom pilot command generating part 3007A outputs a control current corresponding to the generated pilot pressure command value, to the electromagnetic valve 31BL and the electromagnetic valve 31BR. Thereby, the electromagnetic valve 31BL and the electromagnetic valve 31BR can apply a pilot pressure corresponding to the pilot pressure command value, to the corresponding pilot port of the control valve 175. When the pilot pressure is applied to the pilot port, the control valve 175 is driven. When the control valve 175 is driven, the boom cylinder 7 moves, and so as to achieve a boom angle corresponding to the boom command value β1r, the boom 4 moves.

Based on a difference between the arm command value β2r and a calculation value (measurement value) of the current arm angle calculated by an arm angle calculating part 3008B, the arm pilot command generating part 3007B generates a pilot pressure command value to be applied to the control valve 176 corresponding to the arm cylinder 8 that drives the arm 5. The arm pilot command generating part 3007B outputs a control current corresponding to the generated pilot pressure command value, to the electromagnetic valve 31AL and the electromagnetic valve 31AR. Thereby, the electromagnetic valve 31AL and the electromagnetic valve 31AR can apply the pilot pressure corresponding to the pilot pressure command value, to the pilot port of the control valve 176. When the pilot pressure is applied to the pilot port, the control valve 176 is driven. When the control valve 176 is driven, the arm cylinder 8 moves, and so as to achieve the arm angle corresponding to the arm command value β2*r*, the arm 5 moves.

Based on a difference between the bucket command value β3*r* and a calculation value (measurement value) of the current bucket angle calculated by a bucket angle calculating part 3008C, the bucket pilot command generating part 3007C generates a pilot pressure command value to be applied to the control valve 174 corresponding to the bucket cylinder 9 that drives the bucket 6. The bucket pilot command generating part 3007C outputs a control current corresponding to the generated pilot pressure command value, to the electromagnetic valve 31CL and the electromagnetic valve 31CR. Thereby, the electromagnetic valve 31CL and the electromagnetic valve 31CR can apply the pilot pressure corresponding to the pilot pressure command value, to the pilot port of the control valve 174. When the pilot pressure is applied to the pilot port, the control valve 174 is driven. When the control valve 174 is driven, the bucket cylinder 9 moves, and so as to achieve the bucket angle corresponding to the bucket command value β3*r*, the bucket 6 moves.

Based on a difference between the swiveling command value β4*r* and a calculation value (measurement value) of the current swiveling angle calculated by a swiveling angle calculating part 3008D, the swiveling pilot command generating part 3007D generates a pilot pressure command value to be applied to the control valve 173 corresponding to the swiveling hydraulic motor 2A that drives the upper swiveling body 3. The swiveling pilot command generating part 3007D outputs a control current corresponding to the generated pilot pressure command value, to the electromagnetic valve 31DL and the electromagnetic valve 31DR. Thereby, the electromagnetic valve 31DL and the electromagnetic valve 31DR can apply the pilot pressure corresponding to the pilot pressure command value, to the pilot port of the control valve 173. When the pilot pressure is applied to the pilot port, the control valve 173 is driven. When the control valve 173 is driven, the swiveling hydraulic motor 2A moves, and so as to achieve the swiveling angle corresponding to the swiveling command value β4*r*, the upper swiveling body 3 moves (swivels).

The posture angle calculating part 3008 is configured to calculate (measure) the boom angle β1, the arm angle β2, the bucket angle β3, and the swiveling angle β4 based on detection signals of the boom angle sensor S1, the arm angle sensor S2, the bucket angle sensor S3, and the swivel angular velocity sensor S5. Specifically, the posture angle calculating part 3008 includes the boom angle calculating part 3008A, the arm angle calculating part 3008B, the bucket angle calculating part 3008C, and the swiveling angle calculating part 3008D. The boom angle calculating part 3008A calculates (measures) the boom angle β1 based on the detection signal taken from the boom angle sensor S1. The arm angle calculating part 3008B calculates (measures) the arm angle β2 based on the detection signal taken from the arm angle sensor S2. The bucket angle calculating part 3008C calculates (measures) the bucket angle β3 based on the detection signal taken from the bucket angle sensor S3. The swiveling angle calculating part 3008D calculates (measures) the swiveling angle β4 based on the detection signal taken from the swivel angular velocity sensor S5.

The limit height obtaining part 3009 is, for example, configured to obtain data in relation to the limit height from the internal memory, an external storage device, or the like. The "limit height" is an allowable maximum height of the mass (earth-and-sand mass) formed of the objects (earth and sand) released to the ground by the releasing movement.

In the illustrated example, the controller 30 is configured to control the movement of the shovel 100 so that the height of the earth-and-sand mass does not excessively exceed the limit height. Specifically, when the height of the earth-and-sand mass formed by the previous releasing movement exceeds the limit height, the target releasing position obtaining part 3002 is configured not to set a position of the top of that earth-and-sand mass as the target releasing position. In this case, for example, the target releasing position obtaining part 3002 sets, as the target releasing position, another position away from the position of the top of that earth-and-sand mass by a predetermined distance or more, with the target releasing position being on the circumference of a circle having a radius of a distance between the top of that earth-and-sand mass and the center point of swiveling. Alternatively, the target releasing position obtaining part 3002 may set, as the target releasing position, another position away from the position of the top of that earth-and-sand mass by a predetermined distance or more, with the target releasing position being on a straight line passing through the top of that earth-and-sand mass and the center point of swiveling.

With this configuration, only by operating the swiveling operation lever while pressing the switch SW after the completion of the excavating movement, the operator of the shovel 100 can position the bucket 6, in which the earth and sand and the like are taken, directly above the target releasing position. Therefore, the controller 30 can reduce a burden on the operator in relation to the releasing movement.

Also, the controller 30 may automatically open the bucket 6 and automatically release the earth and sand in the bucket 6 to the ground after positioning the bucket 6, in which the earth and sand are taken, directly above the target releasing position. In this case, only by operating the swiveling operation lever while pressing the switch SW after the completion of the excavating movement, the operator can position the bucket 6, in which the earth and sand and the like are taken, directly above the target releasing position, and then automatically release the earth and sand in the bucket 6 to the ground. Therefore, the controller 30 can further reduce a burden on the operator in relation to the releasing movement.

Figure 8:
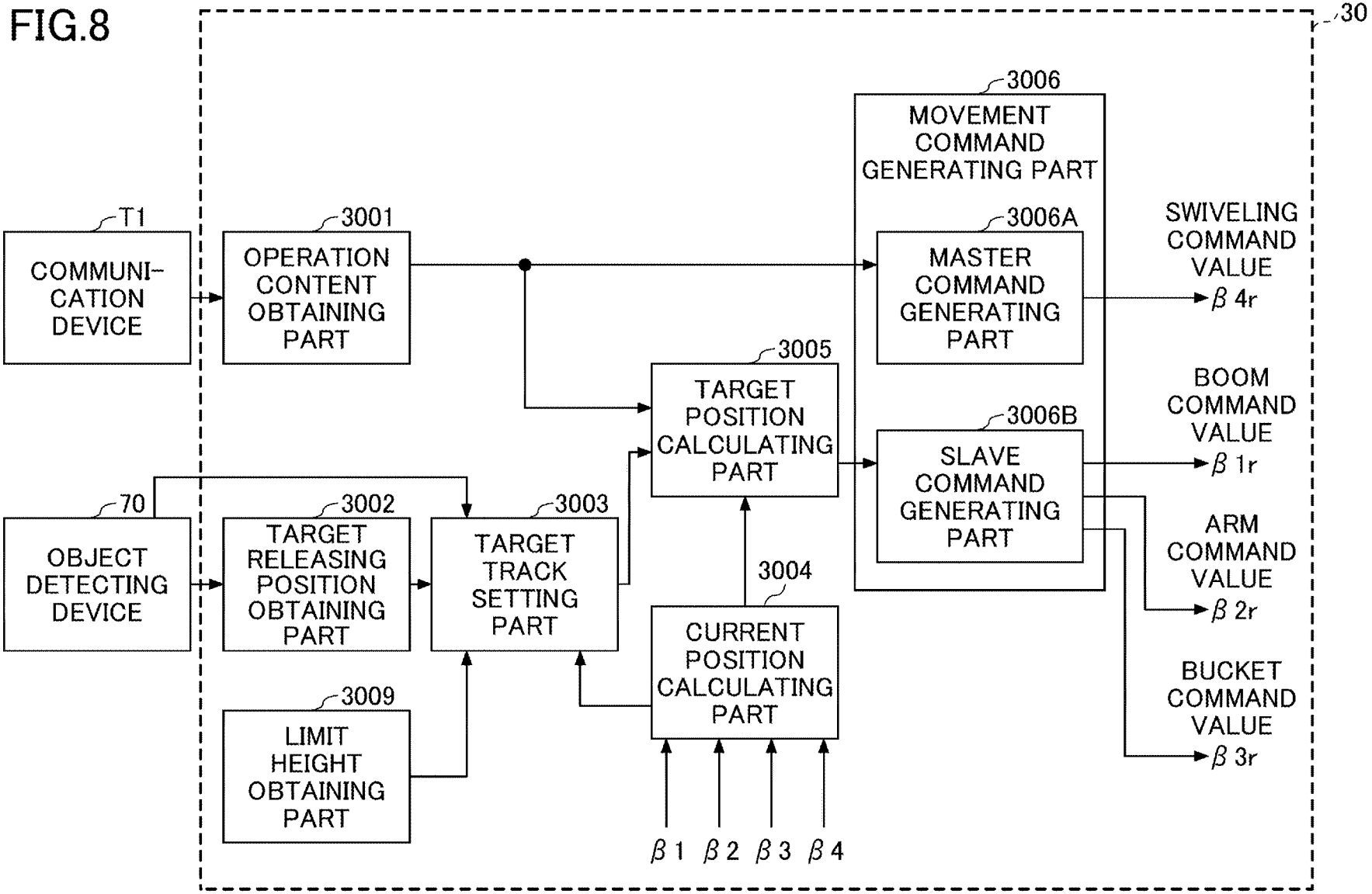
FIG. 8 is a view illustrating another configuration example of the controller.

Next, another detailed configuration example in relation to the machine control function will be described with reference to FIG. 8. FIG. 8 is a view illustrating another configuration example of the controller 30. The controller 30 as illustrated in FIG. 8 is different from the controller 30 as illustrated in FIG. 7A in that the operation content obtaining part 3001 obtains information in relation to the content of the operation through a communication device T1. However, the controller 30 as illustrated in FIG. 8 is the same as the controller 30 as illustrated in FIG. 7A in the rest.

Specifically, the controller 30 of FIG. 8 is a device that is mounted in a remote-controlled shovel or an unmanned (autonomous) shovel. For the unmanned (autonomous) shovel, the target releasing position P for the first releasing movement is previously set. The target releasing position P for the second and subsequent releasing movements may be flexibly set based on the output from the space recognition device 70, or may be previously set. Also, for the remote-controlled shovel, the controller 30 may be placed in a remote-control room. Also, for the unmanned (autonomous) shovel, the controller 30 may be built-in a managing device, such as a server or the like, disposed in an external facility.

As described above, the shovel 100 according to the embodiment of the present disclosure includes, as illustrated in FIG. 5: the lower traveling body 1; the upper swiveling body 3 swivelably mounted on the lower traveling body 1; the attachment AT attached to the upper swiveling body 3 and including the boom 4, the arm 5, and the bucket 6 serving as the end attachment; the space recognition device 70 configured to recognize the feature of the ground; and the controller 30 serving as the control device configured to determine the target releasing position P based on the feature of the ground recognized by the space recognition device 70, and control the swiveling movement of the upper swiveling body 3 so that the upper swiveling body 3 is oriented toward the target releasing position P. Note that, the end attachment may be a member other than the bucket 6, such as a lifting magnet, a grapple, or the like.

With this configuration, for example, only by performing a predetermined operation, such as tilting, of the swiveling operation lever while pressing the switch SW, the operator of the shovel 100 can orient the upper swiveling body 3 toward the target releasing position P. Subsequently, only by moving the attachment AT, the operator can move the end attachment to a position directly above the target releasing position P. Therefore, the shovel 100 can reduce a burden on the operator in relation to the releasing movement.

Note that, when the upper swiveling body 3 is oriented toward the target releasing position P, the controller 30 may be configured to forcibly stop the swiveling of the upper swiveling body 3. In this case, the controller 30 may be configured to smoothly stop the swiveling movement of the upper swiveling body 3 so as to prevent sudden stop of the swiveling movement of the upper swiveling body 3. For example, the controller 30 may gradually reduce the swiveling speed of the upper swiveling body 3. Also, the controller 30 may be configured to continuously control the swiveling speed from the start of swiveling until the stop of swiveling so as to achieve a smooth swiveling movement of the upper swiveling body 3.

With this configuration, for example, only by performing a predetermined operation, such as tilting, of the swiveling operation lever while pressing the switch SW, the operator of the shovel 100 can smoothly swivel the upper swiveling body 3 so that the upper swiveling body 3 is oriented toward the target releasing position P. Therefore, the shovel 100 can prevent occurrence of an event in which the earth and sand fall from the bucket 6 during the swiveling movement, and alleviate anxiety of the operator about possibility of occurrence of such an event. Therefore, the shovel 100 can further reduce a burden on the operator in relation to the releasing movement.

Also, in accordance with the operation of the swiveling operation lever, the controller 30 may be configured to move the end attachment to the position directly above the target releasing position P by swiveling the upper swiveling body 3 and moving the attachment AT.

With this configuration, for example, only by performing a predetermined operation, such as tilting, of the swiveling operation lever while pressing the switch SW, the operator of the shovel 100 can move the end attachment to the position directly above the target releasing position P. Therefore, the shovel 100 can further reduce a burden on the operator in relation to the releasing movement.

Also, the controller 30 may be configured to automatically move the end attachment and release the objects lifted in the air by the attachment AT toward the ground after moving the end attachment to the position directly above the target releasing position P. In the example illustrated in FIG. 5, the controller 30 moves the bucket 6 to the position directly above the target releasing position P, and then automatically opens the bucket 6 and releases, toward the ground, the earth and sand lifted in the air by the attachment AT, i.e., the earth and sand taken in the bucket 6. Note that, when the end attachment is a lifting magnet, the controller 30 moves the lifting magnet to the position directly above the target releasing position P, and then automatically demagnetizes the lifting magnet and releases, toward the ground, the earth and sand lifted in the air by the attachment AT, i.e., magnetic objects attracted by the lifting magnet, such as steel scraps and the like.

With this configuration, only by performing a predetermined operation, such as tilting, of the swiveling operation lever while pressing the switch SW, the operator of the shovel 100 can move the end attachment to the position directly above the target releasing position P, and further release, toward the ground, the objects lifted in the air by the attachment AT. Therefore, the shovel 100 can further reduce a burden on the operator in relation to the releasing movement.

Note that, the target releasing position P may be the position of the top of the mass formed of the objects released to the ground by the past releasing movements. In the example illustrated in FIG. 5, the target releasing position P is the position of the top of the earth-and-sand mass formed of the earth and sand released to the ground by the first releasing movement. However, the target releasing position P may be the center point of a range, in a top view, of the mass formed of the objects released to the ground by the past releasing movements.

Also, the machine learning device according to the embodiment of the present disclosure is configured to learn the target releasing position by utilizing the dataset including combinations of information on the feature of the earth-and-sand mass formed by the soil releasing movement, and preferable releasing positions.

In this case, the trained model created by such a machine learning device is input (stored) in the non-volatile storage device in the controller 30, and the controller 30 may be configured to output, based on the trained model, the target releasing position in accordance with the input of the information on the current feature of the ground.

With this configuration, the controller 30 can derive the target releasing position suitable for the current feature of the ground.

In the above, embodiments of the present invention have been described in detail. However, the present invention is not limited to the above-described embodiments. Various modifications, substitutions, or the like can be applied in the above-described embodiments without departing from the scope of the present invention. In addition, the features that have been separately described can be combined together unless there occurs any technical contradiction.

What is claimed is:

1. A shovel control device, comprising:

a memory; and a hardware processor coupled to the memory and configured to determine a target releasing position based on a feature of a ground recognized by a space recognition device, the target releasing position being a position of a top of a mass formed of an object released to the ground by a past releasing movement; and control a swiveling movement of an upper swiveling body of a shovel so that the upper swiveling body is oriented toward the target releasing position, the shovel including a lower traveling body, the upper swiveling body swivelably mounted on the lower traveling body, an attachment attached to the upper swiveling body and including a boom, an arm, and an end attachment, and the space recognition device configured to recognize the feature of the ground.

2. A shovel, comprising:

a lower traveling body;

an upper swiveling body swivelably mounted on the lower traveling body;

an attachment attached to the upper swiveling body and including a boom, an arm, and an end attachment;

a space recognition device configured to recognize a feature of a ground; and a memory; and a hardware processor coupled to the memory and configured to determine a target releasing position based on the feature of the ground recognized by a space recognition device, the target releasing position being a position of a top of a mass formed of an object released to the ground by a past releasing movement; and control a swiveling movement of the upper swiveling body so that the upper swiveling body is oriented toward the target releasing position.

3. The shovel according to claim 2, wherein the hardware processor is further configured to stop swiveling of the upper swiveling body upon the upper swiveling body being oriented toward the target releasing position.

4. The shovel according to claim 2, wherein the hardware processor is further configured to move the end attachment to a position directly above the target releasing position by swiveling the upper swiveling body and moving the attachment in response to an operation of a swiveling operation lever.

5. The shovel according to claim 4, wherein the hardware processor is further configured to move the end attachment to the position directly above the target releasing position and then to automatically move the end attachment and release an object lifted in air by the attachment, toward the ground.

6. The shovel control device according to claim 1, wherein the hardware processor is further configured to, in response to a height of the mass formed of the object released to the ground by the past releasing movement exceeding a limit height, stop forming the mass and start to form another mass of the object.

7. The shovel control device according to claim 6, wherein the top of the mass formed of the object released to the ground by the past releasing movement is at a position higher than a surface of the ground on which the shovel is positioned.

8. The shovel according to claim 2, wherein the hardware processor is further configured to, in response to a height of the mass formed of the object released to the ground by the past releasing movement exceeding a limit height, stop forming the mass and start to form another mass of the object.

9. The shovel according to claim 8, wherein the top of the mass formed of the object released to the ground by the past releasing movement is at a position higher than a surface of the ground on which the shovel is positioned.

10. A machine learning device, comprising:

a memory; and a hardware processor coupled to the memory and configured to learn a target releasing position by utilizing a dataset including combinations of information on a feature of an earth-and-sand mass formed by a soil releasing movement, and preferable releasing positions, the target releasing position being a position of a top of the earth-and-sand mass formed of soil released to the ground by a past soil releasing movement.

11. A shovel control device, comprising:

a memory; and a hardware processor coupled to the memory and configured to receive an input that is a trained model created by the machine learning device according to claim 10; and output the target releasing position, based on the trained model, in accordance with an input that is information on a current feature of a ground.

* * * * *